US007633480B2

(12) United States Patent
Kubota et al.

(10) Patent No.: US 7,633,480 B2
(45) Date of Patent: Dec. 15, 2009

(54) ELECTRO-OPTICAL DEVICE, DRIVING CIRCUIT OF ELECTRO-OPTICAL DEVICE, AND ELECTRONIC APPARATUS

(75) Inventors: Takehiko Kubota, Suwa (JP); Shinsuke Fujikawa, Chino (JP)

(73) Assignee: Seiko Epson Corporation, Tokyo (JP)

( * ) Notice: Subject to any disclaimer, the term of this patent is extended or adjusted under 35 U.S.C. 154(b) by 758 days.

(21) Appl. No.: 11/322,219

(22) Filed: Jan. 3, 2006

(65) Prior Publication Data

US 2006/0158395 A1 Jul. 20, 2006

(30) Foreign Application Priority Data

Jan. 19, 2005 (JP) ..... 2005-011181

(51) Int. Cl.
*G09G 3/36* (2006.01)

(52) U.S. Cl. ..... 345/98; 345/76; 345/204

(58) Field of Classification Search ..... 345/76, 345/98, 204

See application file for complete search history.

(56) References Cited

U.S. PATENT DOCUMENTS 5,818,068 A * 10/1998 Sasaki et al. ..... 257/59
6,147,667 A * 11/2000 Yamazaki et al. ..... 345/92
6,246,387 B1 * 6/2001 Yamazaki ..... 345/92
6,268,842 B1 * 7/2001 Yamazaki et al. ..... 345/98
6,515,648 B1 * 2/2003 Tanaka et al. ..... 345/100
7,208,763 B2 * 4/2007 Koyama ..... 257/66
7,332,936 B2 * 2/2008 Nagatsuka ..... 326/93
2001/0022581 A1 * 9/2001 Koyama et al. ..... 345/204
2001/0038367 A1 * 11/2001 Inukai ..... 345/76
2004/0169623 A1 * 9/2004 Fujita ..... 345/76
2004/0207579 A1 * 10/2004 Matsumoto ..... 345/76

FOREIGN PATENT DOCUMENTS

JP A 05-241536 9/1993
JP A 09-212133 8/1997

* cited by examiner

*Primary Examiner*—Richard Hjerpe
*Assistant Examiner*—Gregory J Tryder
(74) *Attorney, Agent, or Firm*—Oliff & Berridge, PLC

(57) ABSTRACT

A driving circuit drives an electro-optical device in which a gray-scale level of each of a plurality of electro-optical elements provided so as to correspond to a plurality of data lines is controlled on the basis of a voltage of a corresponding data line. The driving circuit includes a pulse output circuit that outputs a plurality of sampling pulses, each of the plurality of sampling pulses becoming an active level sequentially; a plurality of unit circuits each of which is supplied with a sampling pulse from the pulse output circuit; and a signal line that is supplied with a gray-scale signal to sequentially designate a gray-scale level of each of the electro-optical elements. Each of the plurality of unit circuits has a first switching element that samples the gray-scale signal supplied to the signal line in accordance with a sampling pulse output from the pulse output circuit; a second switching element that is inserted between the first switching element and the data line and enters an off state until a predetermined period passes from a time when sampling operation is started by the first switching element; and a storage capacitor that holds a voltage of an output terminal of the second switching element.

12 Claims, 17 Drawing Sheets

ELECTRO-OPTICAL DEVICE, DRIVING CIRCUIT OF ELECTRO-OPTICAL DEVICE, AND ELECTRONIC APPARATUS

CROSS-REFERENCE TO RELATED APPLICATION

The present application claims priority to Japanese Patent Application No. 2005-011181 filed Jan. 19, 2005, which is hereby expressly incorporated by reference herein its entirety.

BACKGROUND

1. Technical Field

The present invention relates to a technology for controlling an electro-optical element such as an organic light-emitting diode (OLED) element or the like.

2. Related Art

Generally, electro-optical devices with a plurality of electro-optical elements have been widely used. Each of the plurality of electro-optical elements is disposed so as to correspond to any one of a plurality of data lines, and a gray-scale level of each electro-optical element is controlled on the basis of a voltage applied to the corresponding data line. Each of the data lines is commonly connected to a signal line through a switching element disposed so as to correspond to the data line. This signal line is supplied with a gray-scale signal which becomes a voltage in accordance with a gray-scale level of the electro-optical element with a predetermined cycle. The switching elements are sequentially turned on by means of pulse signals (hereinafter, referred to as 'sampling pulses') which sequentially become active levels for every predetermined period (hereinafter, referred to as 'sampling period'), so that gray-scale signals are distributed to the corresponding data lines. As a result, a voltage of each of the data lines becomes a voltage in accordance with a corresponding gray-scale signal.

In this structure, if a period for which a gray-scale signal maintains a level in accordance with a gray-scale level of one electro-optical element and a sampling period with respect to the gray-scale signal are entirely coincident with each other on the time base, a predetermined voltage can be applied to each of the data lines. However, the gray-scale signal may be delayed with respect to the sampling period because of various factors such as a blunt waveform and a voltage drop in the signal line. In this case, since a level of the gray-scale signal varies within one sampling period, the predetermined voltage cannot be applied to each of the data lines. As a result, there is a problem in that irregularity of a gray-scale level (that is, a ghost) occurs along each of the data lines.

As technologies for solving the above-mentioned problem, each of JP-A-5-241536 (FIGS. 1 and 2 in JP-A-5-241536) and JP-A-9-212133 (FIGS. 1 and 2 in JP-A-9-212133) discloses a structure in which each of sampling pulses SMP[j] (j is a natural number) sequentially becomes an active level at a gap D, as shown in FIG. 18. According to this structure, since a gray-scale signal is not sampled by any switching element for a period reaching from an end point of a sampling period Ps to a start point of another sampling period Ps subsequent to the sampling period Ps, even when the gray-scale signal is delayed as shown by 'Dg (delayed)' in FIG. 18, a delayed amount is within a range of a time length of the period D, so that it is possible to prevent a voltage error of the data line from being generated due to a variation of the gray-scale signal.

However, according to the above-mentioned technologies, the time length in which the gray-scale signal is sampled to the data line must be reduced by the gap D. Accordingly, in a case in which the gray-scale signal should be supplied to each of the data lines with a short cycle (for example, in a case in which the total number of the data lines is large), the sufficient gray-scale signal cannot be supplied to each of the data lines, so that it is difficult to control a gray-scale level of each electro-optical element with high precision.

SUMMARY

An advantage of some aspects of the invention is that it provides an electro-optical device capable of preventing a ghost from being generating without reducing a period for which a gray-scale signal is sampled to each data line, a driving circuit of the same, and an electronic apparatus.

According to a first aspect of the invention, there is provided a driving circuit (a so-called horizontal scanning circuit) including: a pulse output circuit that outputs a plurality of sampling pulses, each of the plurality of sampling pulses becoming a high level sequentially; a plurality of unit circuits each of which is supplied with a sampling pulse from the pulse output circuit; and a signal line that is supplied with a gray-scale signal to sequentially designate a gray-scale level of each of the electro-optical elements. Each of the plurality of unit circuits has a first switching element (for example, a transmission gate G1 in preferred embodiments described below) that samples the gray-scale signal supplied to the signal line in accordance with a sampling pulse from the pulse output circuit; a second switching element (for example, a transmission gate G2 or a clocked inverter 38 in preferred embodiments described below) that is inserted between the first switching element and the data line and enters an off state until a predetermnined period passes from a time when sampling starts by the first switching element; and a storage capacitor that holds a voltage of an output terminal of the second switching element.

According to this aspect, since the second switching element enters an off state until the predetermined period passes from the time when the sampling starts by the first switching element, the supply of the gray-scale signal to the data line is stopped. Accordingly, if the amount of the delayed gray-scale signal with respect to the sampling period is within a range of a predetermined period, it is possible to prevent the voltage error of the data line from being generated due to the delay. In addition, even when the second switching element is shifted from the on state to the off state for the predetermined period, a voltage of the output terminal of the second switching element (that is, a voltage applied to the data line or a voltage corresponding to the voltage) is held as a voltage right before the second switching element is shifted from the on state to the off state, by means of the storage capacitor. Accordingly, the voltage according to the gray-scale signal can be applied to the data line with high precision, so that it is possible to prevent the ghost from being generated. The electro-optical element is an element whose optical characteristics such as the transmittance or luminance vary in accordance with electrical operation. For example, the electro-optical element may be an inorganic EL diode element, a light-emitting diode element, or a liquid crystal element as well as the OLED element. Preferably, the storage capacitor is a capacitor element of which one end is connected to the output terminal of the second switching element (for example, a capacitor C in preferred embodiment described below).

Preferably, the driving circuit further includes first and second potential supply lines each of which is supplied with an individual potential and a smoothing capacitor that is inserted between the first potential supply line and the second potential supply line (for example, a capacitor C1 shown in FIG. 5 or 11). Preferably, the other end of the storage capacitor is connected to one end of the smoothing capacitor. According to this aspect, it is possible to stabilize a voltage (and a voltage of the data line) held in the storage capacitor. Preferably, the driving circuit further includes an output buffer that is inserted between the second switching element and the data line (for example, an output buffer 35 shown in FIG. 5 and a clocked inverter 38 shown in FIG. 11). Preferably, the first and second potential supply lines are wiring lines for supplying a power supply potential to the output buffer. According to this aspect, it is possible to simplify the structure of the wiring line of each unit circuit.

Preferably, the pulse output circuit has a shift register that sequentially generates a plurality of pulse signals such that a period for which one pulse signal becomes an active level overlaps a period for which another pulse signal subsequent to the one pulse signal becomes an active level; and logical product circuits each of which outputs a logical product between one pulse signal and another pulse signal subsequent to the one pulse signal as a sampling pulse. Preferably, the second switching element of each unit circuit is controlled such that it is turned on or turned off in accordance with a pulse signal output from the shift register. Preferably, each unit circuit has a logical sum circuit (for example, an OR circuit 36 shown in FIG. 7 or 13) that outputs a signal corresponding to logical sum between a sampling pulse input to the corresponding unit circuit and a sampling pulse input to a unit circuit located at a front stage of the corresponding unit circuit. The second switching element is controlled such that it is turned on or turned off in accordance with a signal output from the logical sum circuit. According to this aspect, it is possible to reduce the output load of the pulse output circuit and it is possible to simplify the structure of the wring line provided near the pulse output circuit.

Preferably, each unit circuit has a delay element inserted between the signal line and the first switching element (for example, a delay circuit 37 shown in FIG. 9 or 14). Preferably, the second switching element of each unit circuit is controlled such that it is turned on or turned off in accordance with a sampling pulse output from the pulse output circuit. According to this aspect, it is possible to apply the predetermined voltage to each data line with high precision.

The driving circuit is used for driving an electro-optical device. According to a second aspect of the invention, there is provided an electro-optical device. The electro-optical device includes a plurality of electro-optical elements that are provided so as to correspond to a plurality of data lines, each having a gray-scale level according to a voltage of a corresponding data line; a pulse output circuit that outputs a plurality of sampling pulses, each of the plurality of sampling pulses becoming an active level sequentially; a plurality of unit circuits each of which is supplied with a sampling pulse output from the pulse output circuit; and a signal line that is supplied with a gray-scale signal to sequentially designate a gray-scale level of each of the electro-optical elements. Each of the plurality of unit circuits has a first switching element that samples the gray-scale signal supplied to the signal line in accordance with a sampling pulse supplied from the pulse output circuit; a second switching element that is inserted between the first switching element and the data line and enters an off state until a predetermined period passes from a time when sampling starts by the first switching element; and a storage capacitor that holds a voltage of an output terminal of the second switching element. In addition, it is possible to achieve the same operation and effect as the driving circuit through the electro-optical device.

Preferably, the electro-optical element is inserted between a first power supply line having a first potential (for example, an anode-side power supply line 51 in preferred embodiments described below) and a second power supply line having a second potential different from the first potential (for example, a cathode-side power supply line 53 in preferred embodiments described below). Further, the storage capacitor has a first capacitor element that has one end connected to an output terminal of the second switching element and has the other end connected to the first power supply line; and a second capacitor element that has one end connected to an output terminal of the second switching element and has the other end connected to the second power supply line. According to this aspect, even when the potential supplied to any one of the first power supply line and the second power supply line varies, it is possible to stably maintain the voltage of the data line.

In addition, an example of the storage capacitor is the capacitor element connected to the output terminal of the second switching element. However, it is not necessary that the storage capacitor is an element provided separately from the other elements. Preferably, the electro-optical device further includes a plurality of pixel circuits each of which has the above-mentioned electro-optical element, and each of the plurality of pixel circuits has a transistor that controls a voltage applied to the electro-optical element in accordance with a voltage applied to a gate electrode through the data line. Preferably, the storage capacitor is a gate capacitor of the transistor (a gate capacitor Cg shown in FIGS. 10 to 14). According to this aspect, it is possible to reduce a size of the circuit as compared with a structure in which the storage capacitor is a separated element.

According to a third aspect of the invention, there is an electronic apparatus comprising the electro-optical device. The electro-optical device is used in various electronic apparatuses. For example, in an image forming apparatus with a photoreceptor in which the image is formed by irradiating the light ray, the electro-optical device is used as a head unit (line head) for irradiating the light ray onto the photoreceptor. Examples of this image forming apparatus may include a printer, a copy machine, or a multifunction machine having these functions. Preferably, in this type of image forming apparatus, an electro-optical device having a plurality of electro-optical element disposed in a line shape is used. Further, the electro-optical device is used as a display device of each of various electronic apparatuses including a cellular phone, a personal computer or the like. In these electronic apparatuses, an electro-optical device is preferably used in which a plurality of electro-optical elements is disposed in a matrix. That is, the electro-optical device includes a plurality of electro-optical elements that are disposed to correspond to intersections of a plurality of scanning lines and a plurality of data lines, a vertical scanning circuit that sequentially selects each of the plurality of scanning lines, and a horizontal scanning circuit that applies a voltage according to the gray-scale signal to the data line when the vertical scanning circuit selects any one of the scanning lines. The electro-optical device is used as a horizontal scanning circuit.

BRIEF DESCRIPTION OF THE DRAWINGS

The invention will be described with reference to the accompanying drawings, wherein like numbers reference like elements, and wherein.

DESCRIPTION OF EXEMPLARY EMBODIMENTS

First Embodiment

Figure 1:
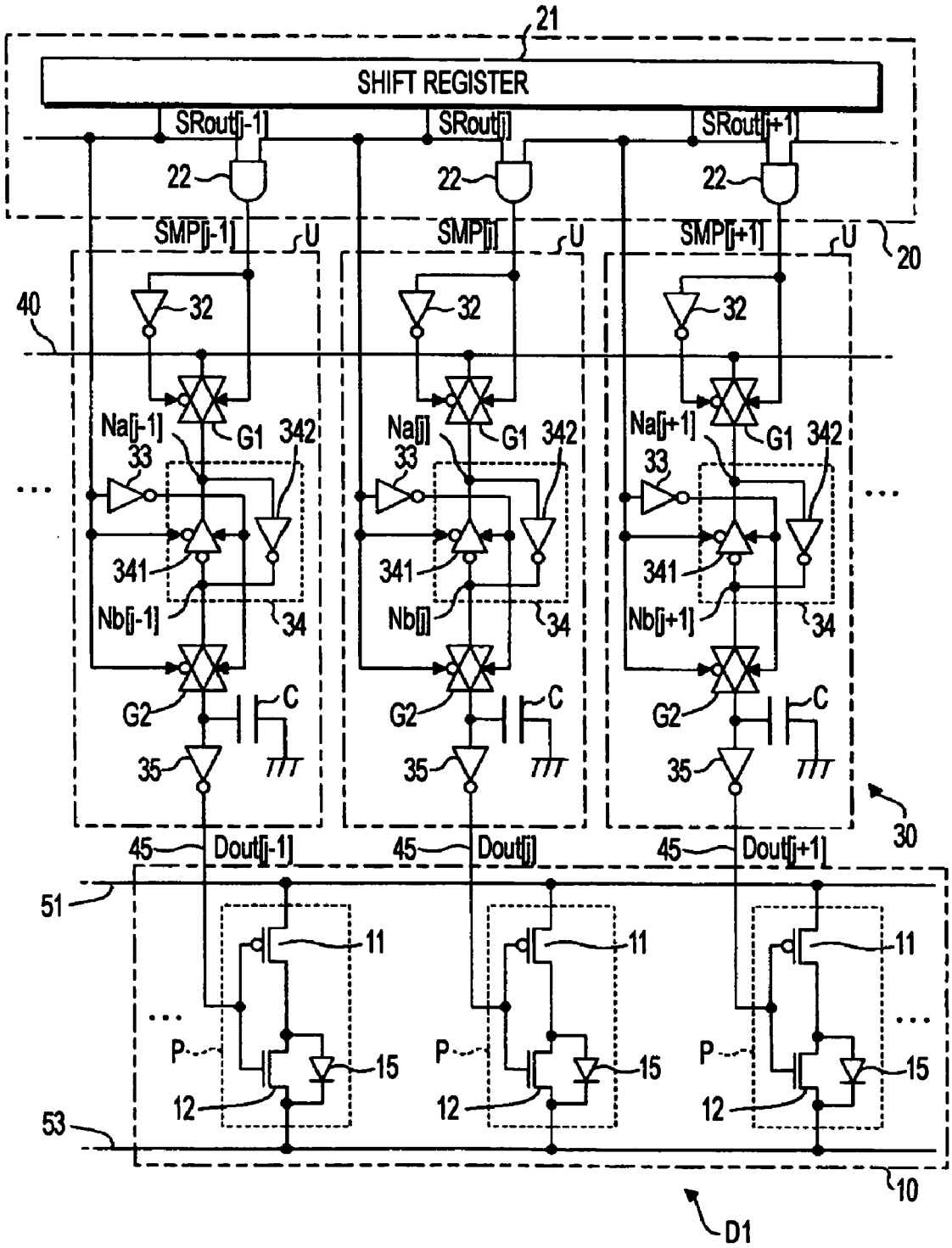
FIG. 1 is a circuit diagram showing a structure of an electro-optical device according to a first embodiment of the invention.

First, a type of an electro-optical device, which is adopted in a head unit of an image forming apparatus (for example, a printer), will be described. FIG. 1 is a circuit diagram showing a structure of this electro-optical device. As shown in FIG. 1, an electro-optical device D1 includes a pixel unit 10, a pulse output circuit 20, and a data output control circuit 30. The pixel unit 10 is a portion used as a line-type optical head, and has a structure in which n pixel circuits P each having an OLED element 15 are disposed in a line. Each of the pixel circuits P is a circuit for controlling turning on and turning off of the OLED element 15, and is connected to a corresponding data line 45 which is disposed in a direction perpendicular to a direction where the pixel circuits P are disposed. In addition, in FIG. 1, only elements corresponding to the (j−1)-th column to the j+1)-th column are shown. However, elements corresponding to the other columns have the same structure (j is a natural number which satisfies the condition $2 \leqq j \leqq n-1$).

Each pixel circuit P has a p-channel-type transistor 11 whose source electrode is connected to an anode-side power supply line 51 and an n-channel-type transistor 12 whose source electrode is connected to a cathode-side power supply line 53. Drain electrodes of the transistors 11 and 12 are connected to each other, and gate electrodes of the transistors 11 and 12 are commonly connected to the data line 45. The OLED element 15 has an anode connected to the drain electrode of the transistor 12 and a cathode connected to the source electrode of the transistor 12. The anode-side power supply line 51 is supplied with a light-emitting power supply potential VHHe1 generated by a power supply circuit (not shown), and the cathode-side power supply line 53 is supplied with a light-emitting power supply potential VLLe1, which is lower than the light-emitting power supply potential VHHe1, from the power supply circuit. According to this structure, if a voltage Dout of each of the data lines 45 (Dout[1], Dout[2], . . . , and Dout[n]) becomes a low level which allows the transistor 11 to be turned on, a current flows from the anode-side power supply line 51 to the cathode-side power supply line 53 via the OLED element 15, so that the OLED element 15 emits light. In contrast, if the voltage Dout of the data line 45 becomes a high level which allows the transistor 12 to be turned on, the transistor 11 is turned off, so that the supply of the current to the OLED element 15 is stopped. As a result, the OLED element 15 is turned off. In this way, a gray-scale level of the OLED element 15 (light emission and turning off) is controlled on the basis of the voltage Dout of the data line 45.

Each of the pulse output circuit 20 and the data output control circuit 30 controls the voltage Dout of the each data line 45 in accordance with a gray-scale signal Dg supplied to a signal line 40. The gray-scale signal Dg is a voltage signal for designating a gray-scale level of each OLED element 15 by time-sharing it in the order in which the OLED elements 15 are disposed. In the present embodiment, the gray-scale signal Dg becomes any one of a low level signal which instructs light emission of one OLED element 15 and a high level signal which instructs turning off of one OLED element 15 for every predetermined unit time.

The pulse output circuit 20 is a unit which outputs n sampling pulses SMP (SMP[1], SMP[2], . . . , and SMP[n]), which sequentially become an active level. The j-th sampling pulse SMP[j] is a signal for defining a period for which the gray-scale signal Dg is received from the signal line 40 (hereinafter, referred to as 'sampling period') in order to designate a gray-scale level of the j-th OLED element 15.

Figure 2:
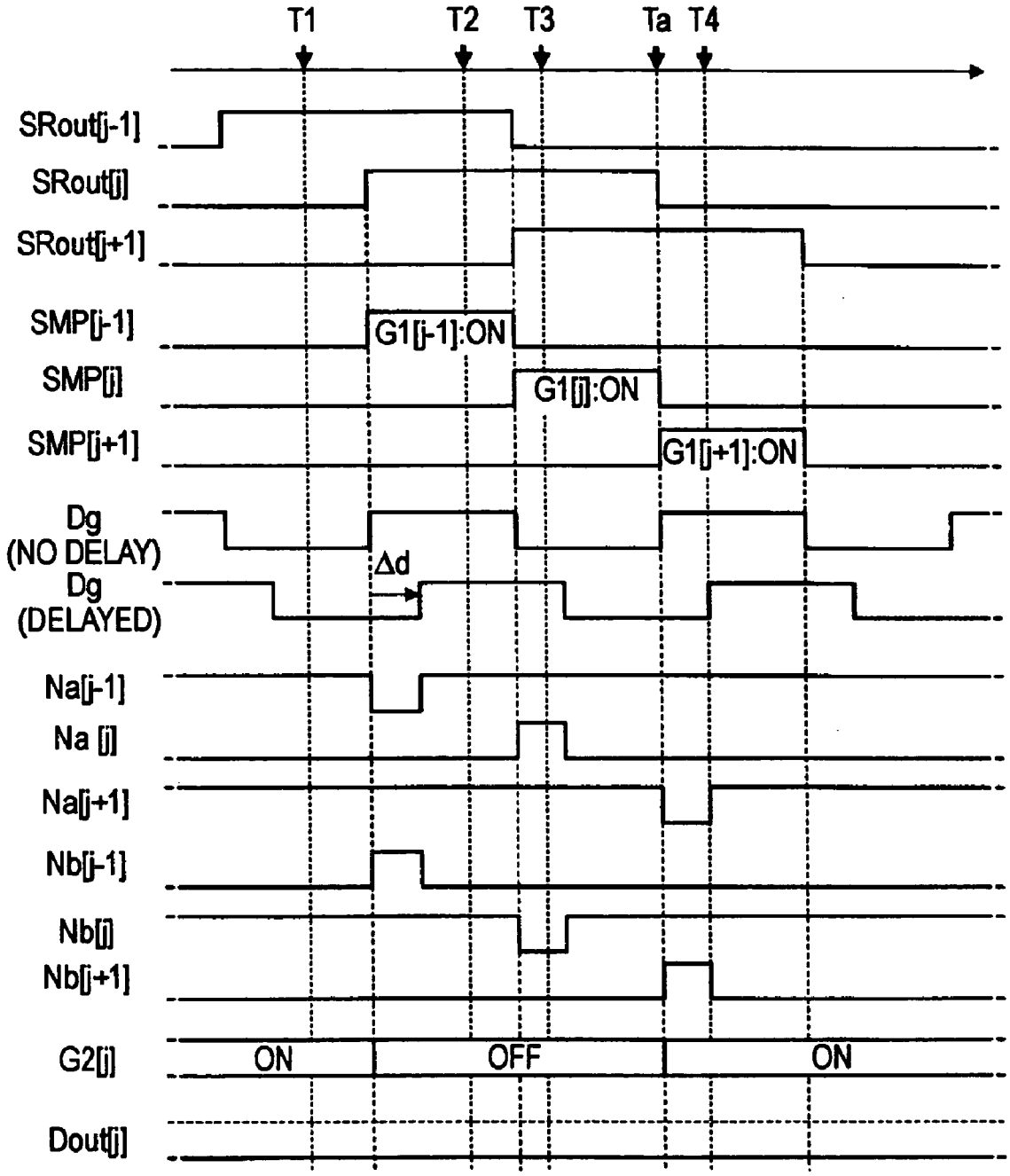
FIG. 2 is a timing chart illustrating the operation of an electro-optical device.

As shown in FIG. 1, the pulse output circuit 20 has a shift register 21 and n AND circuits 22. The shift register 21 is constructed by cascade-connecting n unit shift circuits (not shown) corresponding to the total number of the data lines 45, and shifts starting pulses supplied for a first main-scanning period in accordance with a clock signal so as to sequentially output n pulse signals SRout (SRout[1], SRout[2], . . . , and SRout[n]). Each pulse signal SRout is a signal which becomes an active level for a time corresponding to one cycle of the clock signal. In addition, as shown in FIG. 2, a period for which each pulse signal SRout[j] (j is a natural number which satisfies the condition $1 \leqq j \leqq n$) becomes an active level overlaps a period for which a next pulse signal SRout[j+1] becomes an active level for a time corresponding to half of the cycle of the clock signal.

Each AND circuit 22 operates a logical product between two pulse signals SRout which become active levels sequentially and generates sampling pulses SMP (SMP[1], SMP[2], . . . , and SMP[n]). For example, the j-th AND circuit 22 outputs a sampling pulse SMP[j] corresponding to the logical product between the j-th pulse signal SRout[j] and the (j+1)-th pulse signal SRout[j+1] subsequent to the j-th pulse signal SRout[j]. Accordingly, as shown in FIG. 2, each of the n sampling pulses SMP[1] to SMP[n] output from the pulse output circuit 20 becomes an active level sequentially for each corresponding sampling period without periods for which the sampling pulses become active levels overlapping each other.

Next, the data output control circuit 30 shown in FIG. 1 samples the gray-scale signal Dg to each of the data lines 45 on the basis of each of the sampling pulses SMP[1] to SMP [n], and has n unit circuits U corresponding the total number of the data lines 45. In the below description, a structure of the j-th unit circuit U will be described, but the other unit circuits U may have the same structure as the j-th unit circuit U.

Each unit circuit U has a transmission gate G1. An input terminal of the transmission gate G1 in each of the unit circuits U is commonly connected to the signal line 40. The transmission gate G1 of the j-th unit circuit U is a switching element for sampling the gray-scale signal Dg (interval for designating a gray-scale level of the j-th OLED element 15) on the basis of the sampling pulse SMP[j] output from the j-th AND circuit 22. In other words, the transmission gate G1 is turned on for a period for which the sampling pulse SMP[j] and a signal obtained by inverting a logical level of the sampling pulse SMP[j] through an inverter 32 become active levels (that is, a state in which an output terminal is electrically connected to the signal line 40).

An output terminal of the transmission gate G1 is connected to a latch circuit 34. This latch circuit 34 has a clocked inverter 341 whose output terminal Na[j] is connected to an output terminal of the transmission gate G1, and an inverter 342 whose input terminal is connected to the output terminal Na[j] of the clocked inverter 341 and whose output terminal Nb[j] is connected to an input terminal of the clocked inverter 341. Each control terminal of the clocked inverter 341 is supplied with the pulse signal SRout[j] output from the shift register 21 and a signal obtained by inverting a logical level of the pulse signal SRout[j] through an inverter 33. The clocked inverter 341 enters a high impedance state for a period for which the pulse signal SRout[j] maintains an active level (high level), and functions as an inverter for a period for which the pulse signal SRout[j] maintains a non-active level (low level). Accordingly, the latch circuit 34 latches the gray-scale signal Dg received by the transmission gate G1 for a period for which the pulse signal SRout[j] becomes a non-active level and outputs it to the output terminal Nb[j].

The output terminal Nb[j] of the latch circuit 34 (that is, an output terminal of the inverter 342) is connected to the input terminal of a transmission gate G2. This transmission gate G2 is provided between the transmission gate G1 and the data line 45, and functions as a switching element for switching between the permission and the non-permission of the output of the gray-scale signal Dg to the data line 45 (that is, an interval for which the transmission gate G1 performs the sampling with respect to the j-th OLED element 15). In the same manner as the clocked inverter 341, each control terminal of the transmission gate G2 is supplied with the pulse signal SRout[j] and a signal obtained by inverting a logical level of the pulse signal SRout[j]. For a period for which the pulse signal SRout[j] maintains a non-active level (low level), the transmission gate G2 is turned on (conductive state), which allows the gray-scale signal Dg to be supplied to the data line 45. In contrast, for a period for which the pulse signal SRout[j] maintains an active level (high level), the transmission gate G2 is turned off (non-conductive state), so that the supply of the gray-scale signal Dg to the data line 45 is stopped. The logical level of the gray-scale signal Dg output from the transmission gate G2, which is turned on, is inverted by the output inverter 35, and is then output to the j-th data line 45. The output inverter 35 functions as an output buffer of the data output control circuit 30.

As shown in FIG. 1, each of the unit circuits U has a capacitor C. This capacitor C holds a voltage of the output terminal of the transmission gate G2 (input terminal of the output inverter 35), and has one end connected to the output terminal of the transmission gate G2 and the other end connected to a ground. When the transmission gate G2 is turned off, the voltage Dout[j] of the data line 45 is held such that it has a level obtained by inverting through the output inverter 35 the logical level held in the capacitor C when the transmission gate G2 is turned on.

Next, the operation of an electro-optical device D1 according to the present embodiment will be described. However, in the below description, at the timings T1 to T4 illustrated in FIG. 2, a state of the j-th unit circuit U is mainly described, and the operation of the other unit circuits U will be omitted. At the timing T1, it is assumed that a high level is held in the capacitor C (that is, the voltage Dout[j] of the data line 45 is held to have a low level and the j-th OLED element 15 is turned on). Further, for the convenience of description, it is assumed that instruction is made such that OLED elements 15 of odd-numbered stages including the j-th stage are turned off and OLED elements 15 of even-numbered stages are turned on. Accordingly, as shown in FIG. 2, a logical level of the gray-scale signal Dg is alternately switched from one of the high level and the low level to the other for every unit time (a period having the same time length as the sampling period).

Timing T1

At the timing T1, since the pulse signal SRout[j] output from the shift register 21 maintains the low level, the sampling pulse SMP[j] output from the AND circuit 22 maintains the low level. Therefore, the transmission gate G1 is turned off and the gray-scale signal Dg supplied to the signal line 40 is not received in the j-th unit circuit U. Further, at the timing T1, the clocked inverter 341 of the latch circuit 34 enters an on state to serve as an inverter. In addition, the transmission gate G2 is turned on, so that the output terminal Nb[j] of the latch circuit 34 is electrically connected to the input terminal of the output inverter 35.

Timing T2

At the timing T2, the pulse signal SRout[j] is shifted from the low level to the high level. Accordingly, the clocked inverter 341 of the latch circuit 34 enters a high impedance state, and the transmission gate G2 is turned off, so that the output terminal Nb[j] of the latch circuit 34 is electrically separated from the input terminal of the output inverter 35. At this time, since the logical level held in the capacitor C is maintained as the high level, the logical level of the voltage Dout[j] of the j-th data line 45 is maintained as the low level. Further, at the timing T2, since the pulse signal SRout[j+1] is maintained as the low level, the sampling pulse SMP[j] is maintained as the low level, so that the transmission gate G1 maintains an off state. Accordingly, the gray-scale signal Dg supplied to the signal line 40 is not received in the j-th unit circuit U.

Timing T3

At the timing T3, since the pulse signals SRout[j] and SRout[j+1] become high levels, the sampling pulse SMP[j], which is the logical product between the pulse signals SRout [j] and SRout[j+1], becomes the high level, so that the transmission gate G1 is shifted from the off state to the on state. For the sampling period for which the sampling pulse SMP[j]

becomes the high level, the gray-scale signal Dg supplied to the signal line 40 is supplied to the input terminal Na[j] of the latch circuit 34 through the transmission gate G1. However, since the clocked inverter 341 has entered a high impedance state by means of the pulse signal SRout[j] of the high level, the clocked inverter 341 and the inverter 342 do not serves as a latch circuit.

Here, if the gray-scale signal Dg is not delayed from a predetermined timing, the gray-scale signal Dg is shifted to a level in accordance with a gray-scale level of each OLED element 15 with a timing at which a logical level of each of the sampling pulses SMP[1] to SMP[n] is shifted, as shown in FIG. 2. However, in the gray-scale signal Dg, a delay occurs due to various factors such as a blunt waveform or a voltage drop in the signal line 40. In the present embodiment, as represented as 'Dg (delayed)' in FIG. 2, it is assumed that the gray-scale signal Dg is delayed more than a predetermined timing by a time length Δd. Since the delayed gray-scale signal Dg is received from the signal line 40 through the transmission gate G1, the voltage of the input terminal Na[j] for the sampling period becomes a high level for a period until the length of the time Δd passes from a starting point of the sampling period in spite of the fact that the low level should be originally maintained from the starting point of the sampling period to the end point, as shown in FIG. 2. In contrast, the voltage of the output terminal Nb[j] of the latch circuit 34 becomes a low level for a period until the length of the time Δd passes from a starting point of the sampling period. Accordingly, if the level obtained by inverting the logical level of the output terminal Nb[j] through the output inverter 35 is applied to the data line 45 as it is, the voltage of the data line 45, which should be originally maintained as the low level (a level to make the OLED element 15 emit light), is shifted from the low level to the high level for a period corresponding to the length of the time Δd. As a result, for the corresponding period, the OLED element 15 is turned off. The ghost is caused by a luminance error (here, luminance reduction).

In the present embodiment, as shown in FIG. 2, at the timing T3, since the transmission gate G2 maintains an off state by means of the pulse signal SRout[j] maintained as a high level, the gray-scale signal Dg received by the transmission gate G1 reaches only the input terminal of the transmission gate G2, so that the gray-scale signal Dg is not output to the data line 45. Therefore, the voltage Dout[j] of the data line 45 maintains the low level obtained by inverting through the output inverter 35 the high level held in the capacitor C at the corresponding time. In addition, actually, even though the voltage of the output terminal Nb[j] is changing due to the delay of the gray-scale signal Dg, its influence does not appear in the voltage of the data line 45. That is, the voltage Dout[j] of the data line 45 is maintained as a predetermined level (here, low level), so that the OLED element 15 is turned on from a starting point of the sampling period to the end point. Accordingly, the ghost caused by the delay of the gray-scale signal Dg is not generated.

Timing T4

If the pulse signal SRout[j] output from the shift register 21 is shifted from the high level to the low level at a timing Ta, the clocked inverter 341 enters an on state to start to function as an inverter, and the transmission gate G2 enters an on state, so that the output terminal Nb[j] of the latch circuit 34 is electrically connected to the input terminal of the output inverter 35. The gray-scale signal Dg, which is received by the transmission gate G1 at the timing Ta, is latched by the latch circuit 34, and is then output to the data line 45 through the transmission gate G2 and the output inverter 35. Accordingly, at the timing T4 after the timing T3 passes, the voltage Dout[j] of the data line 45 is maintained as a low level which is a predetermined logical level, so that the transistor 11 is turned on and the OLED element 15 emits light. After the timing Ta passes, the high level, which is a logical level of the output terminal Nb[j] of the latch circuit 34, is held in the capacitor C connected to the output terminal of the transmission gate G2. In this way, the logical level according to the gray-scale signal Dg is held in the capacitor C, so that the voltage Dout[j] of the data line 45 is maintained as the low level even when the transmission gate G2 (and the clocked inverter 341) enters an off state, as described with respect to the timing T2. In addition, since the sampling pulse SMP[j] maintains the low level right after the timing Ta, so that the transmission gate G1 enters an off state, the sampling operation of the gray-scale signal Dg to the latch circuit 34 is stopped.

As described above, in the present embodiment, the transmission gate G2 enters an off state for a period until the predetermined time passes from the start of the sampling through the transmission gate G1, so that the supply of the gray-scale signal Dg to the data line 45 is stopped. Therefore, it is possible to prevent an error of the voltage Dout of the data line 45 from being generated due to the delay of the gray-scale signal Dg. Further, since the voltage of the output terminal of the transmission gate G1 is held in the capacitor C, the data line 45 is applied with the predetermined voltage Dout for a period for which the transmission gate G1 maintains an off state. Accordingly, according to the present embodiment, a predetermined voltage Dout is supplied to each of the data lines 45 with high precision, so that it is possible to prevent the ghost from being generated.

Figure 3:
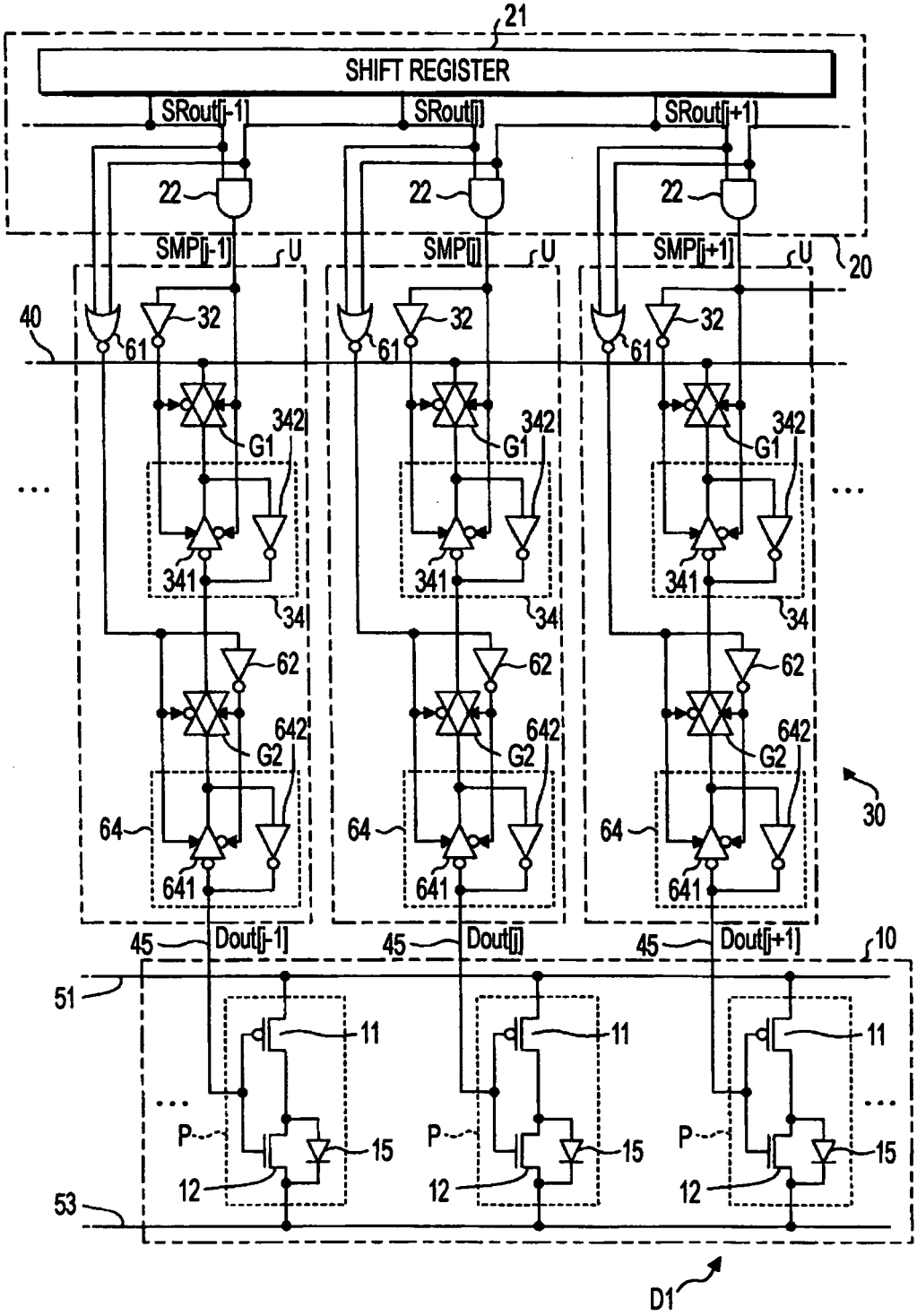
FIG. 3 is a circuit diagram showing a structure of an electro-optical device in which latch circuits 34 and 64 of two steps are disposed.
Figure 4:
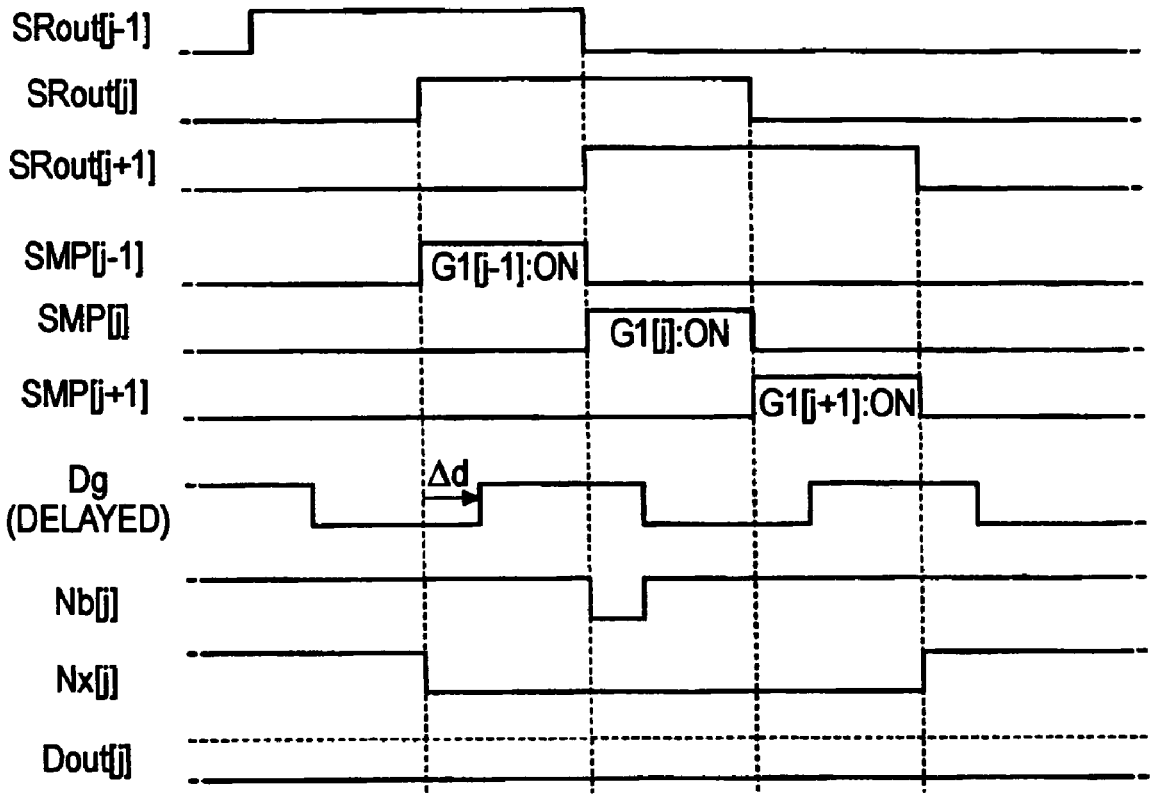
FIG. 4 is a timing chart illustrating the operation of the electro-optical device.

In addition, a structure shown in FIG. 3 may be considered as a structure constructed such that the delay of the gray-scale signal Dg does not affect the voltage Dout of the data line 45. According to this structure, a latch circuit 64, which is composed of the clocked inverter 641 and the inverter 642, is disposed at a rear stage of the transmission gate G2 of each unit circuit U. In addition, the state of the transmission gate G2 of the j-th unit circuit U and the state of the clocked inverter 641 of the latch circuit 64 are controlled by a signal obtained by inverting the logical product between the pulse signal SRout[j] and the pulse signal SRout[j+1] subsequent to the pulse signal SRout[j] so as to be shifted from any one of an on state and an off state to the other. Even in this structure, as shown in FIG. 4, for a period for which the transmission gate G1 enters an on state and the gray-scale signal Dg is received (a period for which an output terminal Nx[j] of an NOR circuit 61 becomes a low level), the transmission gate G2 enters an off state, so that the signal line 40 and the data line 45 are electrically separated from each other. In addition, since the gray-scale signal Dg latched to the latch circuit 64 is output to the data line 45, it is possible to achieve the same effect as the structure shown in FIG. 1. However, according to the structure of FIG. 3, there is a problem in that since the latch circuit 64 is disposed at the rear stage of the transmission gate G2 of each unit circuit U, the structure of the data output control circuit 30 becomes complicated (in particular, the structure of the wring lines becomes complicated) or a circuit size becomes larger, and thus a yield of the electro-optical device D1 may decrease or a manufacturing cost may increase. In contrast, according to the present embodiment, since the capacitor C and the output inverter 35 may be disposed at the rear stage of the transmission gate G2, as compared with the structure of FIG. 3, the structure of the data output control circuit 30 may be simplified or the circuit size may decrease, so that it is possible to resolve the above-mentioned problem in that a yield of the electro-optical device D1 may decrease or a manufacturing cost may increase.

Modification of First Embodiment

Next, various modified aspects of the first embodiment will be described. Further, the various aspects of the first embodiment described below may be suitably combined. Hereinafter, in the various aspects, the same constituent elements as the first embodiment will be denoted by the same reference numerals as FIG. 1 and the description thereof will be omitted.

First Aspect

Figure 5:
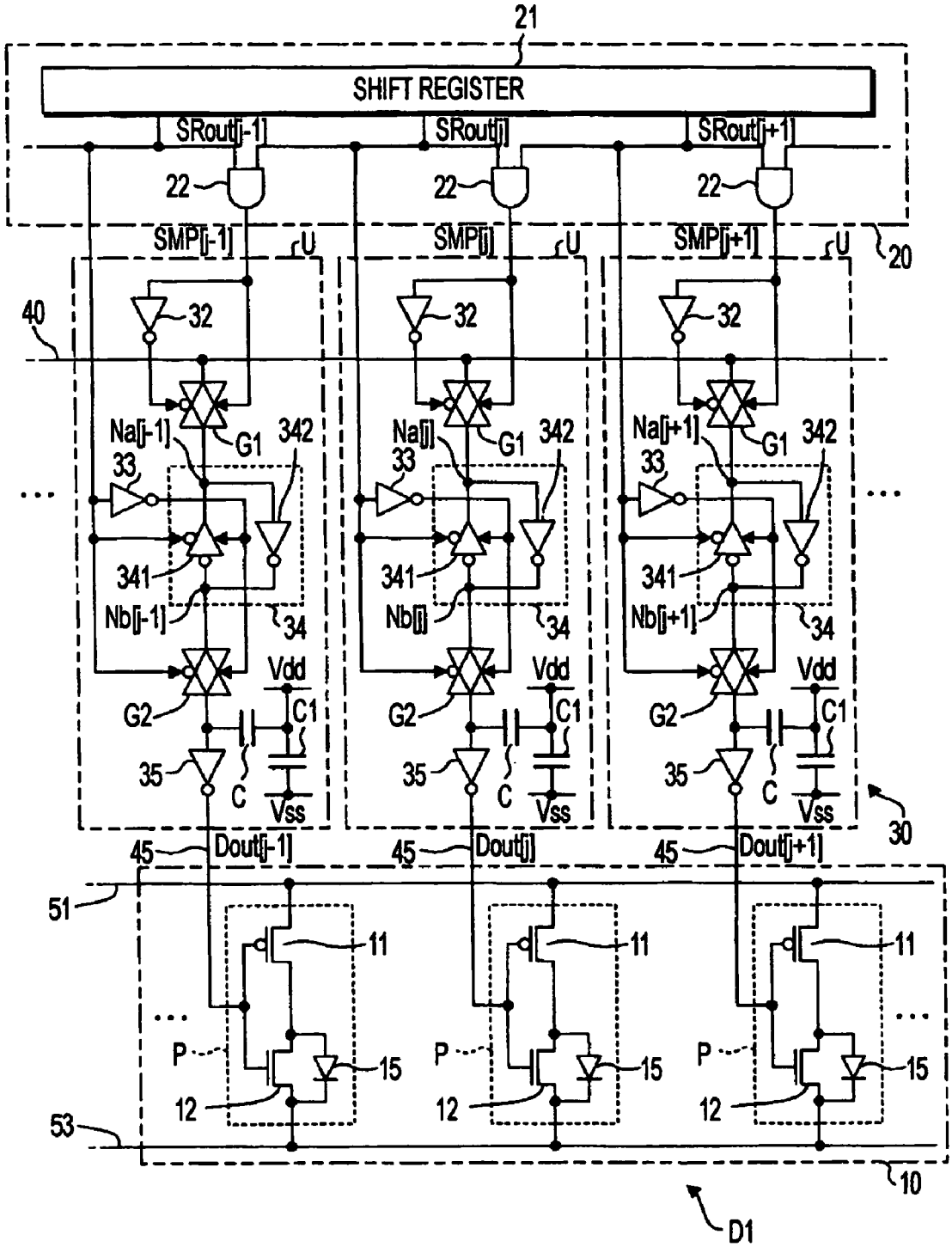
FIG. 5 is a circuit diagram showing a structure of a modification (first aspect) of the electro-optical device according to the first embodiment.

FIG. 5 is a circuit diagram showing a structure of the electro-optical device D1 according to the first aspect obtained by modifying the first embodiment. In FIG. 1, one end of the capacitor C is connected to a ground, but in the electro-optical device D1 according to the present aspect, one end of the capacitor C is connected to wiring lines including a wiring line to which a higher potential of a power supply Vdd is supplied (hereinafter, referred to as 'higher power supply line') and a wiring line to which a lower potential of a power supply Vss is supplied (hereinafter, referred to as 'lower power supply line'). The higher potential Vdd and the lower potential Vss are used as a power supply of the logic circuit of the pulse output circuit 20 or the data output control circuit 30 (in particularly, output inverter 35). The capacitor C1 is provided between the higher power supply line and the lower power supply line, and the other end of the capacitor C whose one end is connected to the transmission gate G2 is connected to a terminal of the capacitor C1 located at the side of a higher power supply line (or a terminal of the capacitor C1 located at the side of a lower power supply line).

According to this structure, even when the higher potential Vdd supplied to the higher power supply line or the lower potential Vss supplied to the lower power supply line vary due to any reasons (for example, charge and discharge in another logical circuit), this variation is smoothed by the capacitor C1. Accordingly, according to the present aspect, the voltage of the data line 45 can be stabilized regardless of the variation of the potential of each power supply line. Further, the higher power supply line and the lower power supply line for supplying the power supply to the output inverter 35 cross wiring lines reaching from the output terminal of the transmission gate G2 to the input terminal of the output inverter 35, so that the capacitor C can be formed. Therefore, it is possible to reduce the circuit size of the data output control circuit 30 as compared with the structure in which the capacitor C is disposed so as to be separated from these wiring lines.

Here, the structure is exemplified in which one end of the capacitor C is connected to the higher power supply line or the lower power supply line, but it may be connected to other wiring lines. For example, the capacitor C1 may be provided between the anode-side power supply line 51 and the cathode-side power supply line 53 and one end of the capacitor C may be connected to the anode-side power supply line 51 or the cathode-side power supply line 53. According to this structure, even when the current is supplied to the OLED element 15 and the potential of the anode-side power supply line 51 or cathode-side power supply line 53 varies, it is possible to stably maintain the voltage of the capacitor C.

Second Aspect

Figure 6:
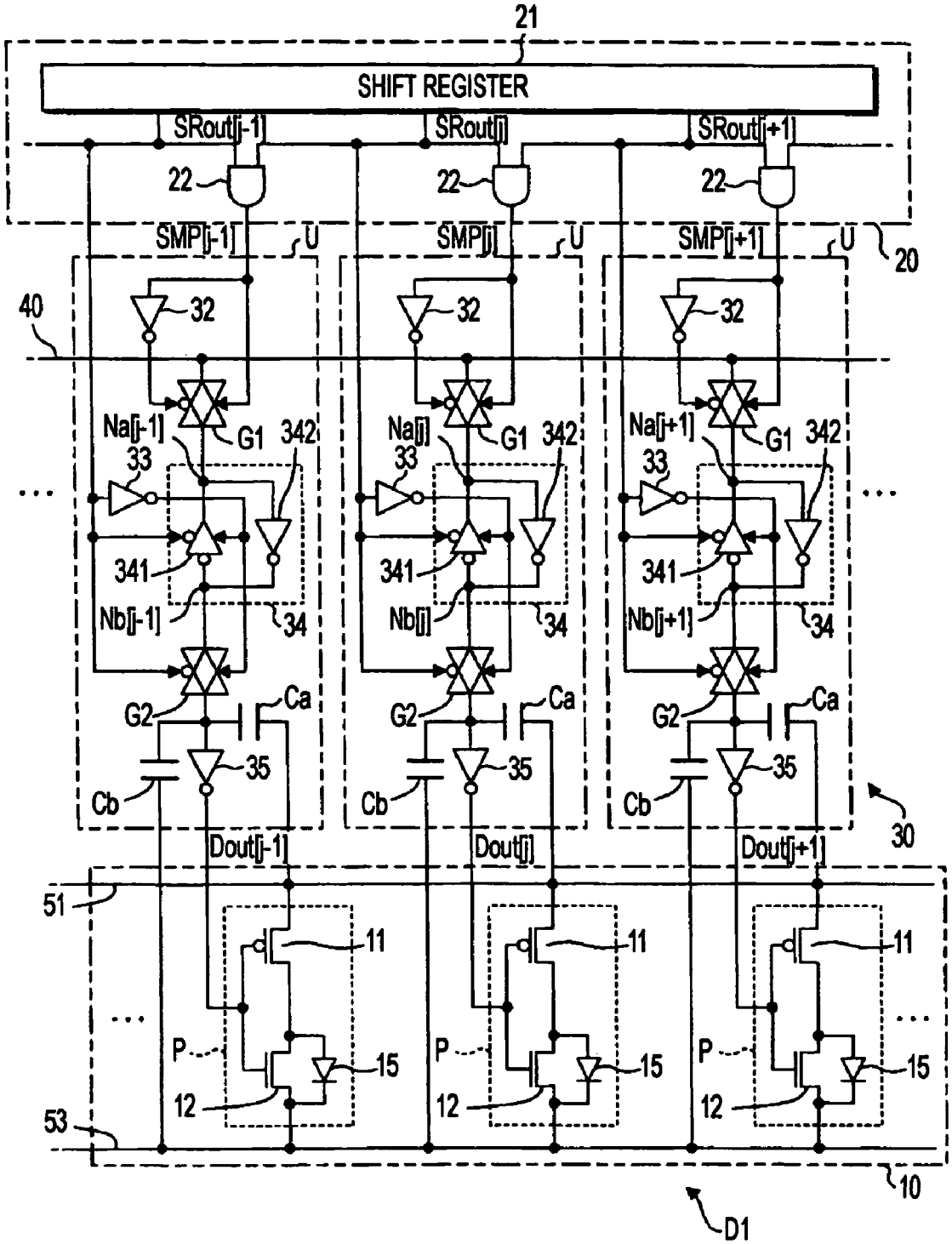
FIG. 6 is a circuit diagram showing a structure of a modification (second aspect) of the electro-optical device according to the first embodiment.

FIG. 6 is a circuit diagram showing a structure of the electro-optical device D1 according to the second aspect obtained by modifying the first embodiment. In FIG. 6, according to the present aspect, each unit circuit U has capacitors Ca and Cb. One end of the capacitor Ca is connected to an output terminal of a transmission gate G2 and the other end of the capacitor Ca is connected to an anode-side power supply line 51. One end of the capacitor Cb is connected to the output terminal of a transmission gate G2 and the other end of the capacitor Cb is connected to a cathode-side power supply line 53. According to this structure, even though any one of a light-emitting power supply potential VHHe1 supplied to the anode-side power supply line 51 and a light-emitting power supply potential VLLe1 supplied to the cathode-side power supply line 53 varies in accordance with light emission of an OLED element 15, the other can be stably maintained. Therefore, it is possible to stabilize a voltage held in each of the capacitors Ca and Cb. In addition, it is possible to constitute the capacitors Ca and Cb through a simple structure that wiring lines reaching from the transmission gate G2 to the output inverter 35 are superimposed on the anode-side power supply line 51 and the cathode-side power supply line 53.

Third Aspect

Figure 7:
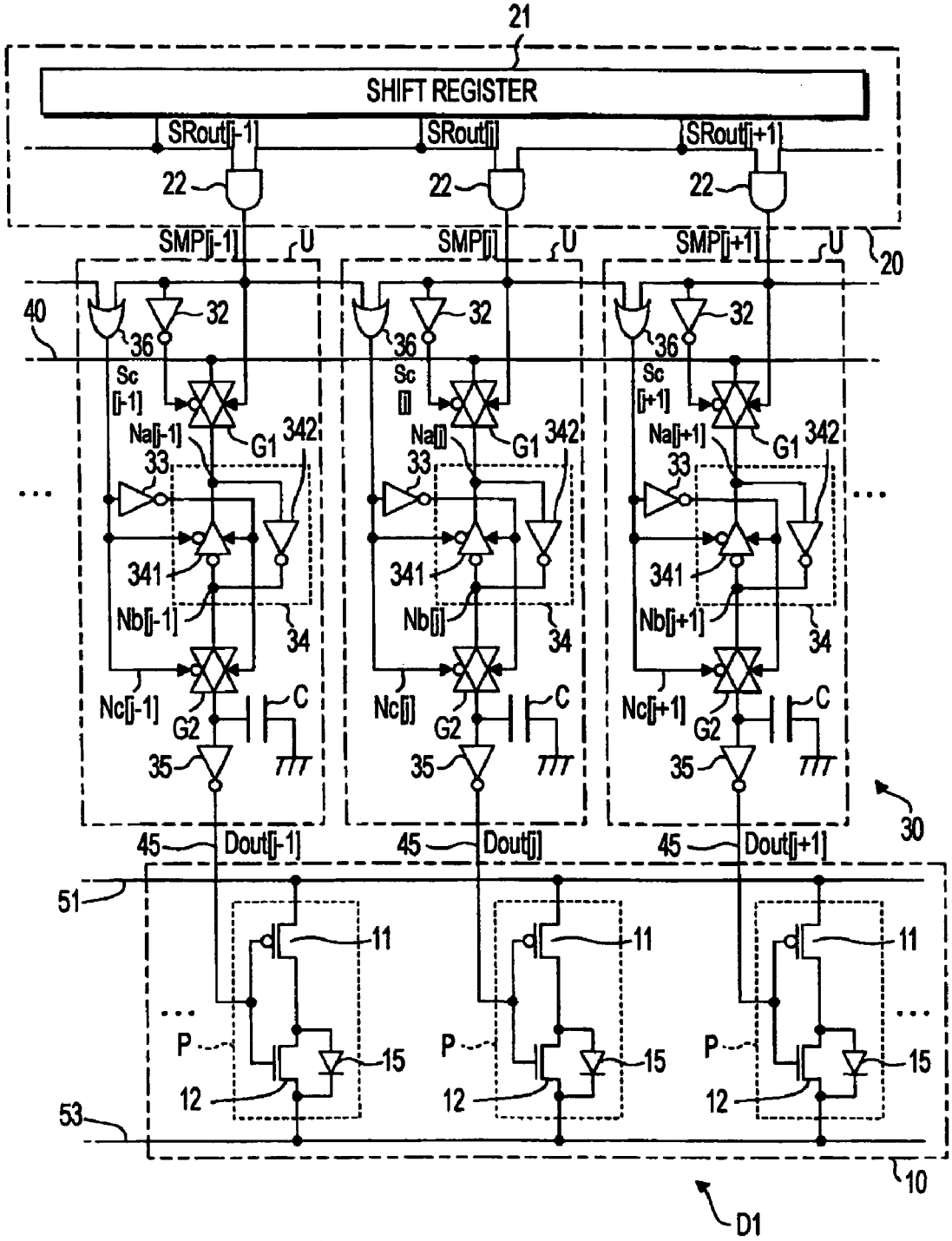
FIG. 7 is a circuit diagram showing a structure of a modification (third aspect) of the electro-optical device according to the first embodiment.
Figure 8:
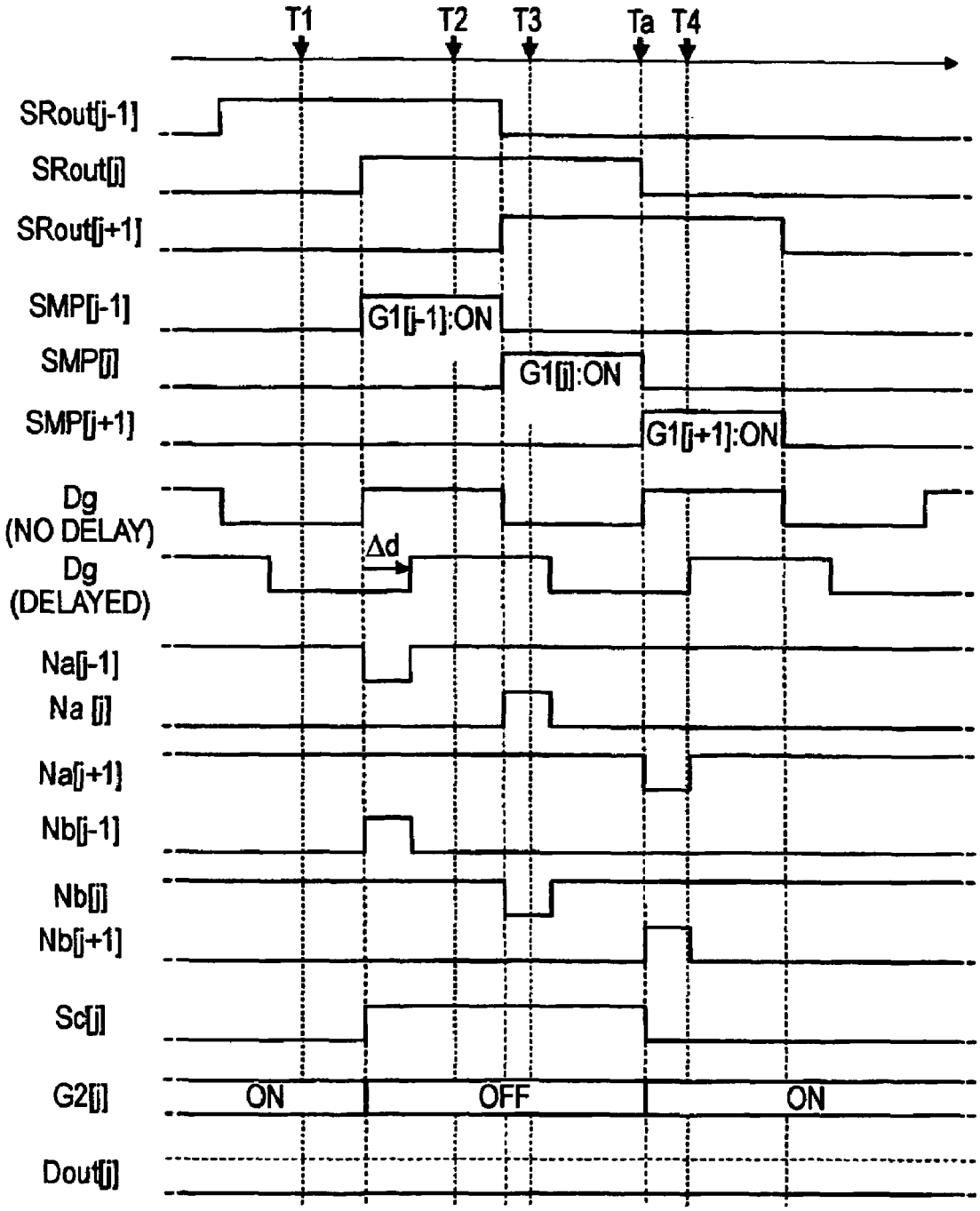
FIG. 8 is a timing chart illustrating the operation of the electro-optical device according to the third aspect.

FIG. 7 is a circuit diagram showing a structure of the electro-optical device D1 according to the third aspect obtained by modifying the first embodiment. As shown in FIG. 7, according to the present aspect, each unit circuit U has an OR circuit 36. An OR circuit 36 of the j-th unit circuit U outputs a control signal Sc[j] corresponding to logical sum between a sampling pulse SMP[j] input from a pulse output circuit 20 to the corresponding unit circuit U and a sampling pulse SMP[j−1] which becomes active right before the sampling pulse SMP[j]. A clocked inverter 341 and a transmission gate G2 in each of the unit circuits U are controlled on the basis of the control signal Sc. As shown in FIG. 8, the control signal Sc has the almost same waveform as the pulse signal SRout[j]. Accordingly, even in the present aspect, it is possible to achieve the same operation and effect as the first embodiment. In addition, according to the present aspect, there are advantages in that the output load of the shift register 21 can be reduced, and the wiring lines connected the output terminal of the shift register 21 can be simplified.

Fourth Aspect

Figure 9:
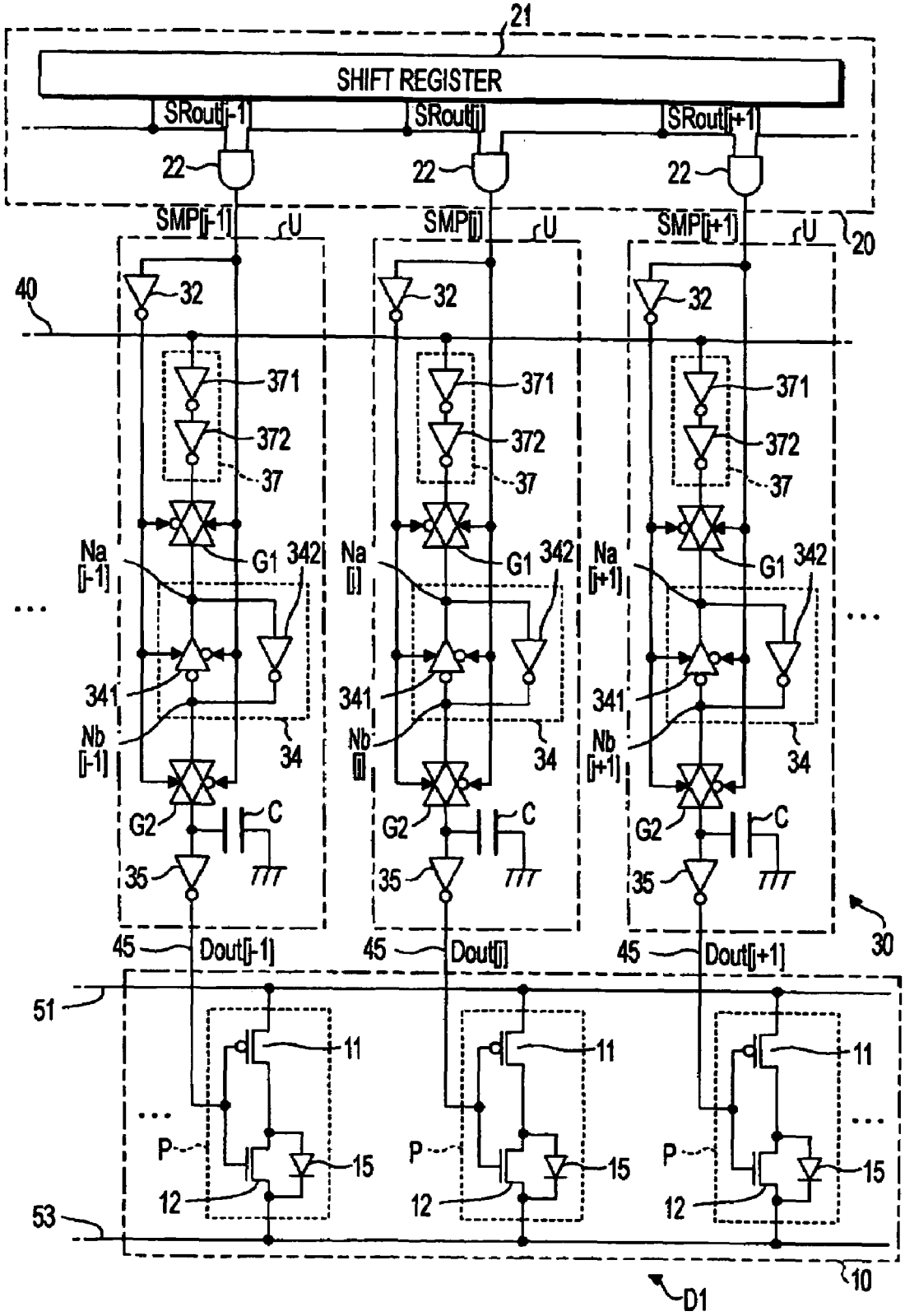
FIG. 9 is a circuit diagram showing a structure of a modification (fourth aspect) of the electro-optical device according to the first embodiment.

FIG. 9 is a circuit diagram showing a structure of the electro-optical device D1 according to the fourth aspect obtained by modifying the first embodiment. As shown in FIG. 9, according to the present aspect, a delay circuit 37 is provided between the transmission gate G1 and the signal line 40. This delay circuit 37 is a circuit in which an inverter 371 having an input terminal connected to the signal line 40 is connected in series to an inverter 372 having an output terminal connected to an input terminal of the transmission gate G1. If a state of the transmission gate G1 is shifted from an off state to an on state, a gray-scale signal Dg supplied to the signal line 40 is delayed by the delay circuit 37 as much as a predetermined time and is then input to the latch circuit 34. In addition, the state of the transmission gate G2 included in the j-th unit circuit U and the state of the clocked inverter 341 of the latch circuit 34 are controlled by the sampling pulse SMP[j] output from the AND circuit 22 and a signal obtained by inverting a logical level of the sampling pulse SMP[j] through the inverter 32 such that a state of each of them is shifted from any one of an on state and an off state to the other.

As such, the sampling pulse SMP[j] for controlling the transmission gate G1 serves to control the transmission gate G2 or the clocked inverter 341, so that the structure of the data output control circuit 30 can be simplified. Further, since the pulse signal SRout[j] output from the shift register 21 is not used for controlling the transmission gate G2 or the clocked inverter 341, it is possible to obtain the same effect as the third aspect. That is, the output load of the shift register 21 can be reduced and the wiring lines connected the output terminal of the shift register 21 can be simplified.

In addition, in the structure in which the clocked inverter 341 is controlled on the basis of the sampling pulse SMP[j], the moment the sampling pulse SMP[j] is shifted from the high level to the low level and the clocked inverter 341 enters an on state, the gray-scale signal Dg received by the transmission gate G1 may be output to the data line 45 through the clocked inverter 341 and the transmission gate G2. Accordingly, by an error of the gray scale signal Dg on the time base, an interval of the gray-scale signal Dg, which designates the gray-scale levels of the OLED elements 15 other than the j-th OLED element 15, may be output to the j-th data line 45. In contrast, according to the present aspect, since the gray-scale signal Dg received by the latch circuit 34 through the transmission gate G1 is delayed by the delay circuit 37, the sampling pulse SMP[j] becomes an active level, so that the logical level of the gray-scale signal Dg varies after the transmission gate G2 enters an off state. Therefore, it is possible to apply the predetermined voltage Dout[j] to each data line 45 with high precision.

Second Embodiment

Next, a structure of an electro-optical device according to a second embodiment of the invention will be described. In the present embodiment, the same constituent elements as the first embodiment and the modification thereof will be denoted by the same reference numerals and the description thereof will be omitted.

Figure 10:
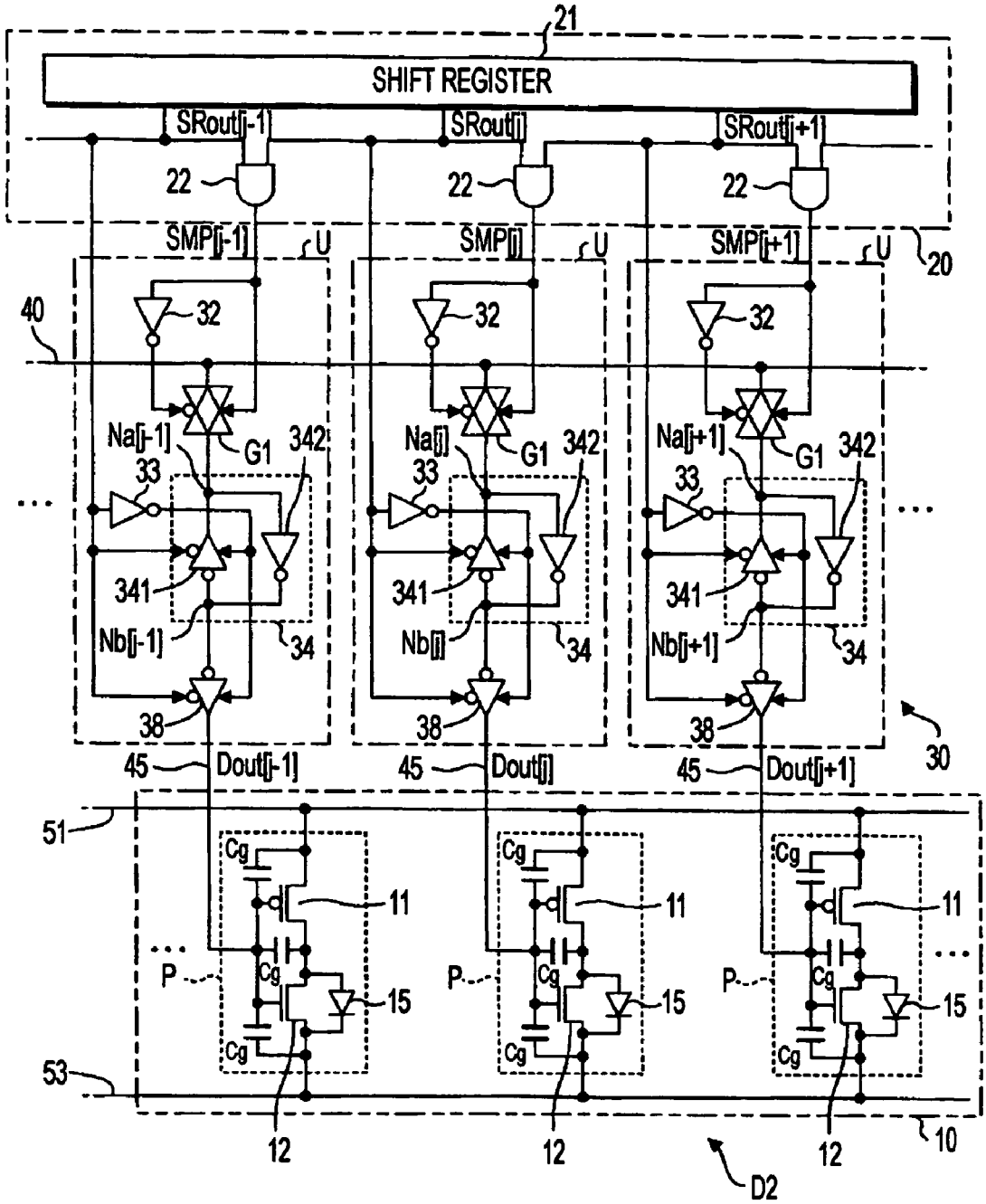
FIG. 10 is a circuit diagram showing a structure of an electro-optical device according to a second embodiment of the invention.

FIG. 10 is a circuit diagram showing a structure of the electro-optical device according to the present embodiment. As shown in FIG. 10, each unit circuit U of the electro-optical device D2 has a clocked inverter 38 instead of the transmission gate G2, the output inverter 35, and the capacitor C shown in FIG. 1. In more detail, the clocked inverter 38 included in the j-th unit circuit U has an input terminal connected to an output terminal Nb[j] of the latch circuit 34 and an output terminal connected to the data line 45. In addition, the clocked inverter 38 enters an off state (a high impedance state) for a period for which the pulse signal SRout[j] output from the shift register 21 becomes a high level and enters an on state for a period for which the pulse signal SRout[j] becomes a low level, so that the clocked inverter 38 serves as an inverter. That is, the clocked inverter 38 in the present embodiment is a switching element serving as both the transmission gate G2 and the output inverter 35 in the first embodiment.

In the present embodiment, a capacitor for holding the voltage Dout[j] of the data line 45 (that is, a capacitor corresponding to the capacitor C of FIG. 1) needs to be provided for a period for which the clocked inverter 38 maintains an off state. In the structure shown in FIG. 10, gate capacitors Cg in the transistors 11 and 12 of the pixel circuit P are used as capacitors for holding the voltage Dout[j] of the data line 45. That is, the gate capacitor Cg is additionally provided between a gate and a source or between a gate and a drain of the transistor 11 or the transistor 12. Particularly, in the pixel circuit P in which the OLED element 15 is used as the electro-optical element, a size of the transistor 11 or the transistor 12 is large so as to supply a sufficient current to the OLED element 15. Therefore, each gate capacitor Cg has a sufficient capacitance so as to hold the voltage Dout[j] of the data line 45.

In the gate capacitor Cg, the voltage Dout[j] of the data line 45 when the clocked inverter 38 is shifted from an off state to an on state is held, and the level of the voltage Dout[j] of the data line 45 is maintained as it is for a period for which the clocked inverter 38 maintains an off state. Accordingly, even in the present embodiment, the same operation and effect as the first embodiment can be obtained. Further, in the present embodiment, since one clocked inverter 38 is used instead of the transmission gate G2 and the output inverter 35 according to the first embodiment, it is possible to reduce the size of the data output control circuit 30 as compared with the structure of FIG. 1. Furthermore, since the voltage Dout[j] of the data line 45 is held by the gate capacitor Cg, the capacitor C according to the first embodiment becomes unnecessary, so that it is possible to reduce the size of the data output control circuit 30 from this point of view.

Modification of Second Embodiment

Next, various modified aspects of the second embodiment will be described. Further, the various aspects of the second embodiment described below may be suitably combined. Hereinafter, in the various aspects, the same constituent elements as the first embodiment and the second embodiment will be described by the same reference numerals as FIGS. 1 and 10 and the description thereof will be omitted.

First Aspect

Figure 11:
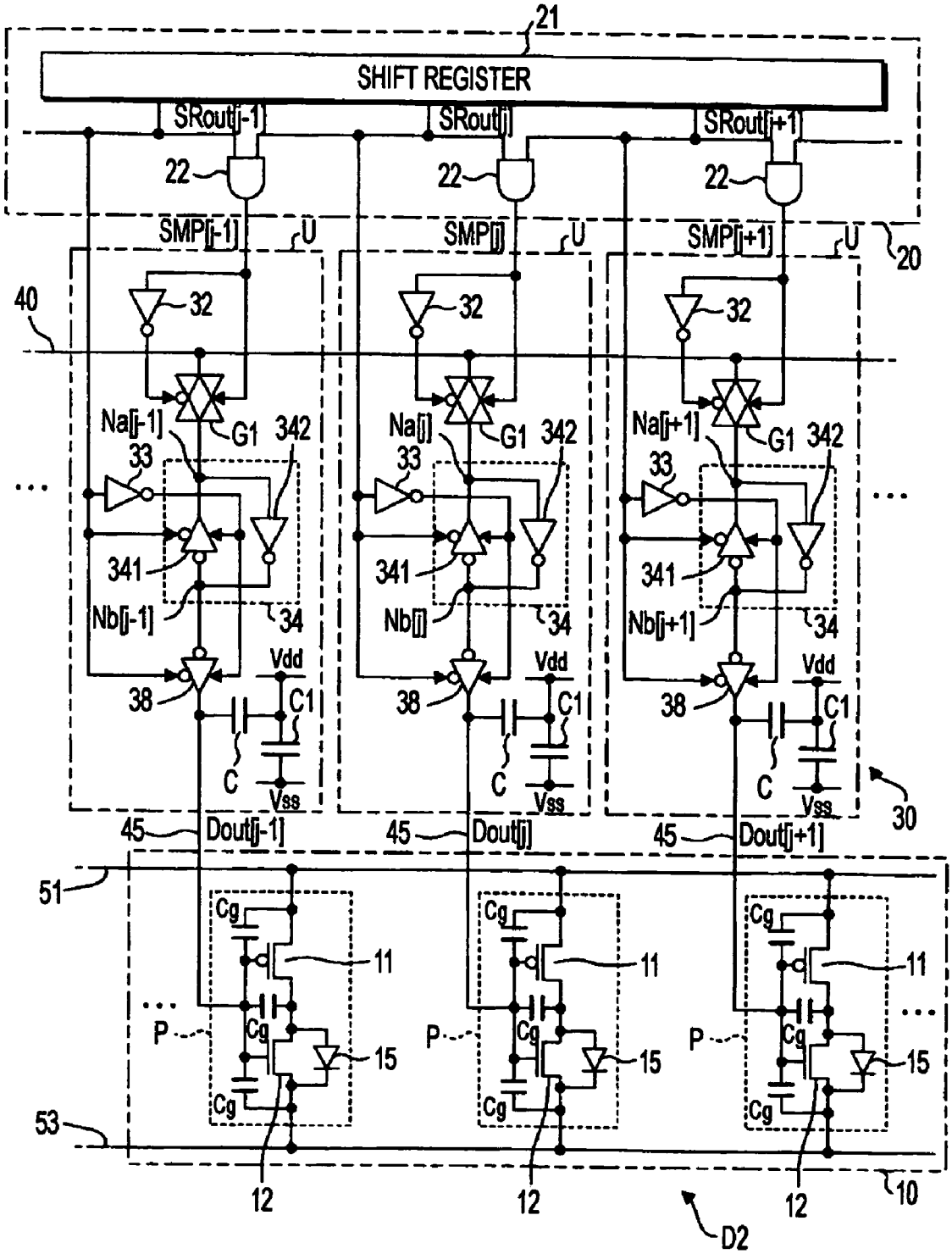
FIG. 11 is a circuit diagram showing a structure of a modification (first aspect) of the electro-optical device according to the second embodiment.
Figure 12:
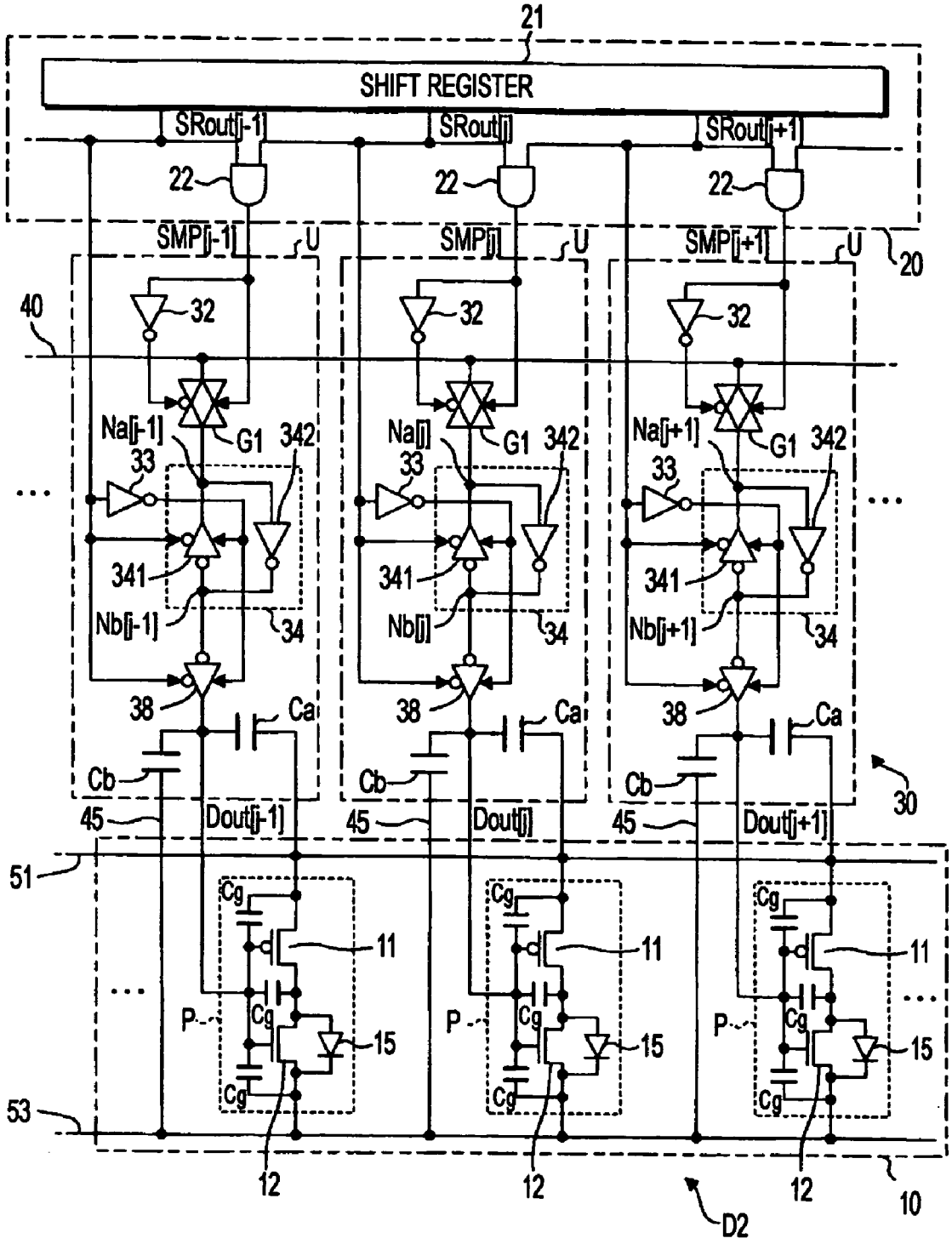
FIG. 12 is a circuit diagram showing a structure of an electro-optical device according to another aspect.

In FIG. 10, the voltage Dout of the data line 45 is held by only the gate capacitor Cg. However, one end of the same capacitor C as the first embodiment may be connected to the output terminal of the clocked inverter 38. The structure shown in FIG. 5 or 6 may be applied to the present embodiment. For example, as shown in FIG. 11, a structure may be used in which one end of the capacitor C is connected to a wring line for connecting a higher power supply line supplied with the higher potential of the power supply Vdd and a lower power supply line supplied with the lower potential of the power supply Vss or a structure may be used in which one end of the capacitor C is connected to one end of the capacitor C1 provided between the higher power supply line and the lower power supply line. In addition, as shown in FIG. 12, a structure may be used in which a capacitor Ca is provided between the output terminal of the clocked inverter 38 and the anode-side power supply line 51 or a structure may be used in which the capacitor Cb is provided between the output terminal and the cathode-side power supply line 53. According to this aspect, the structure of the data output control circuit 30 can be simplified and the voltage Dout of the data line 45 can be stably maintained.

Second Aspect

Figure 13:
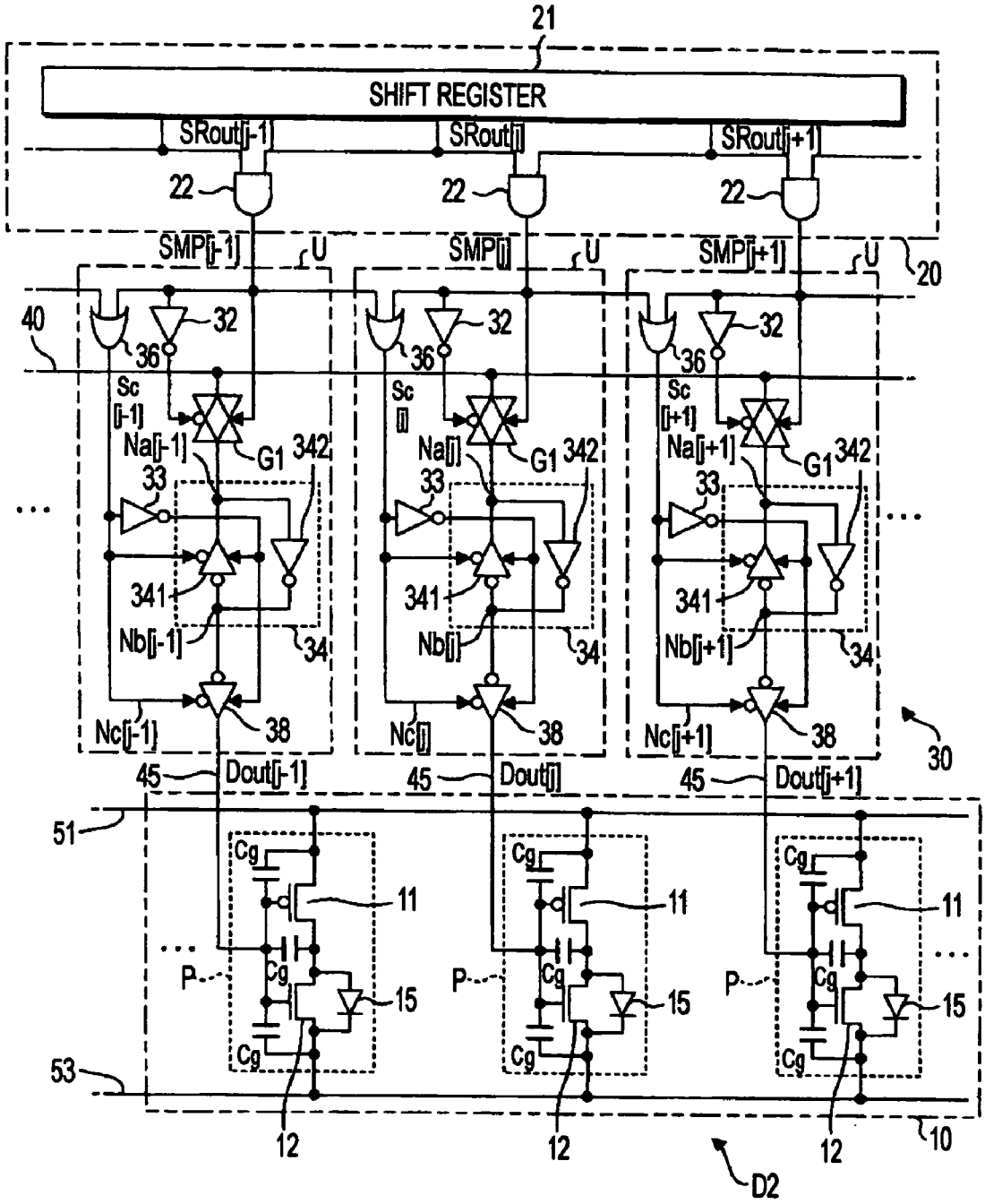
FIG. 13 is a circuit diagram showing a structure of a modification (second aspect) of the electro-optical device according to the second embodiment.

The structure shown in FIG. 7 may be applied to the second embodiment. That is, as shown in FIG. 13, a control signal Sc[j] corresponding to logical sum between the pulse signal SRout[j] and the pulse signal SRout[j−1] of the front stage thereof is generated by an OR circuit 36. For a period for which the control signal Sc[j] is a high level, the clocked inverter 38 may be shifted from an on state to an off state, and for a period for which the control signal Sc[j] is a low level, the clocked inverter 38 may be an on state.

Third Aspect

Figure 14:
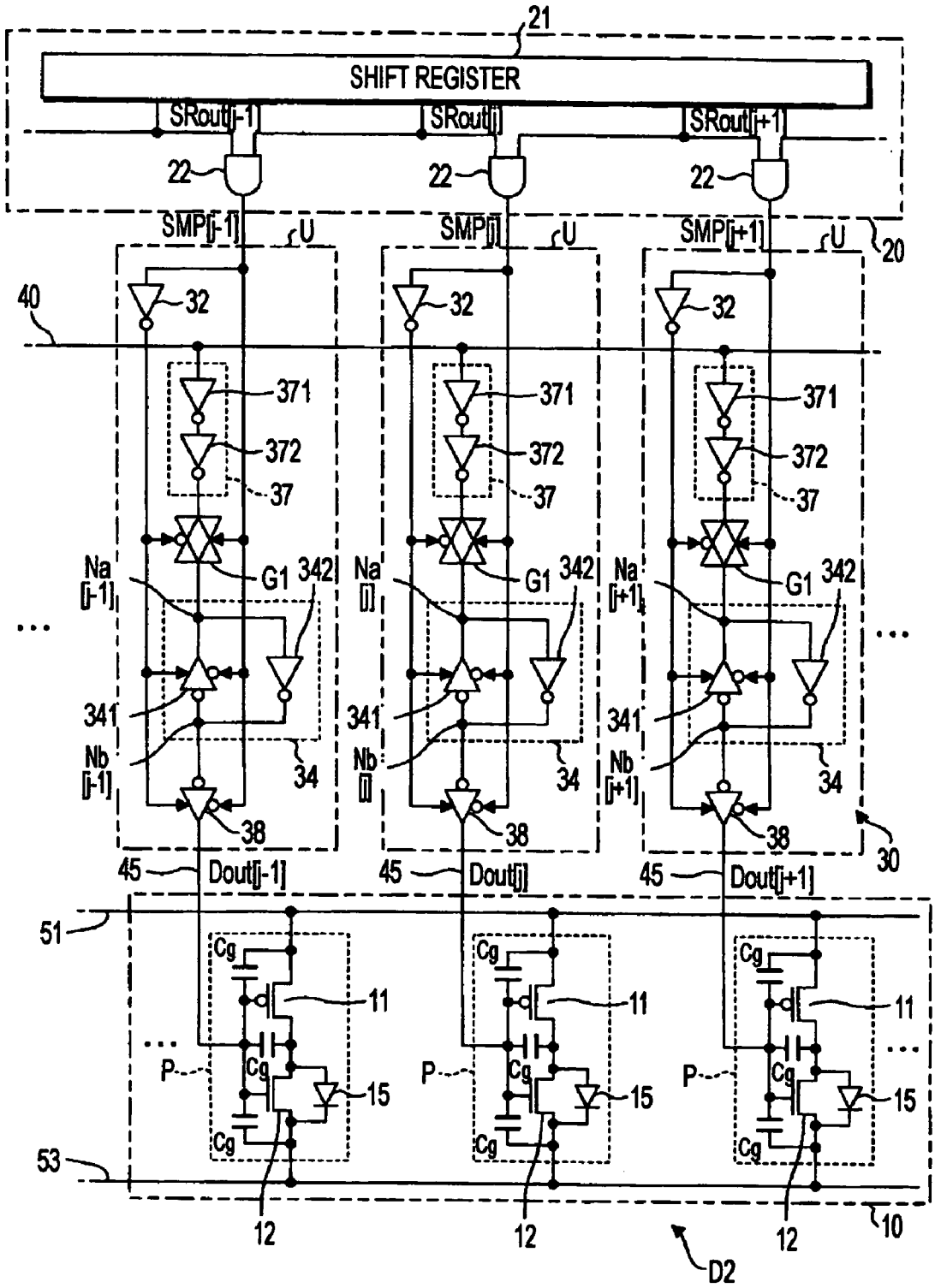
FIG. 14 is a circuit diagram showing a structure of a modification (third aspect) of the electro-optical device according to the second embodiment.

The structure shown in FIG. 9 may be applied to the second embodiment. That is, as shown in FIG. 14, a delay circuit 37 is provided between the transmission gate G1 and the signal line 40, and the clocked inverter 38 may be controlled by the sampling pulse SMP[j] output from the AND circuit 22 and a signal obtained by inverting the logical level of the sampling pulse SMP[j].

Electronic Apparatus

The electro-optical devices D (D1 and D2) according to the above-mentioned embodiments are used in various electronic apparatuses. A structure of an image forming apparatus, which is an example of the electronic apparatus according to the invention, will now be described.

Figure 15:
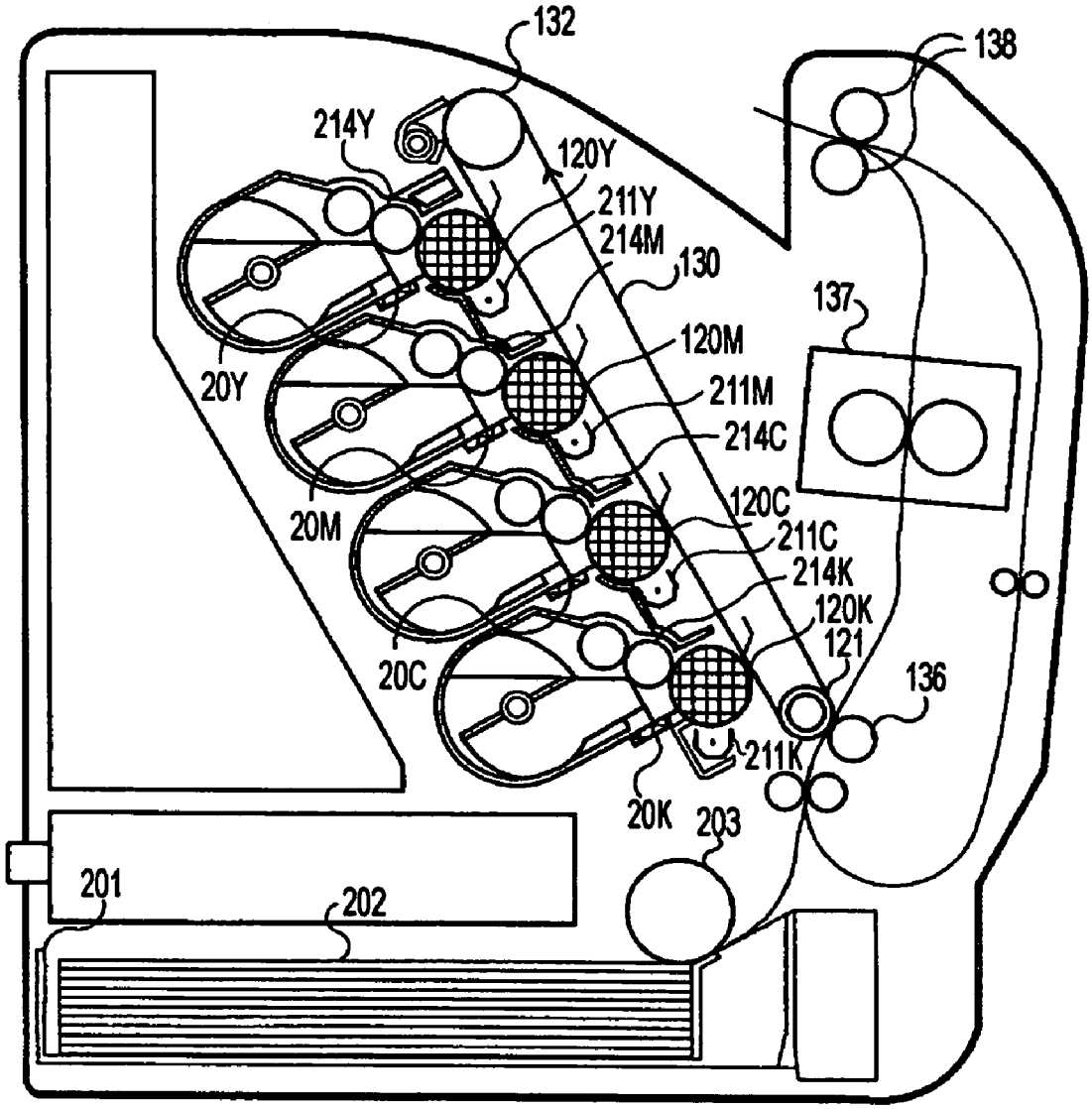
FIG. 15 is a longitudinal cross-sectional view showing a structure of an image forming apparatus.

FIG. 15 is a longitudinal cross-sectional view showing a structure of an image forming apparatus using the electro-optical device D according to the above-mentioned embodiments. The image forming apparatus has a structure in which four organic EL array exposure heads 20K, 20C, 20M, and 20Y having the same structure are disposed at exposure positions of four photoreceptor drums (image carrier) 120K, 120C, 120M, and 120Y having the same structure and in which it has a tandem type. Each of the organic EL array exposure heads 20K, 20C, 20M, and 20Y is formed of the pixel unit 10 of the electro-optical device D according to the above-mentioned embodiments.

As shown in FIG. 15, the image forming apparatus includes a driving roller 121, a driven roller 132, and an intermediate transfer belt 130 which is cyclically driven in an arrow direction. The photoreceptor drums 120K, 120C, 120M, and 120Y, each of which has a photosensitive layer on the outer peripheral surface thereof to serve as an image carrier, are disposed at a predetermined gap along the intermediate transfer belt 130. Here, Suffixes K, C, M, and Y added to reference numerals indicate black, cyan, magenta, and yellow, respectively. That is, the photoreceptor drums designated by reference numerals with such suffixes are photoreceptor drums for black, cyan, magenta, and yellow, respectively. The same is true for other members. The photoreceptor drums 120K, 120C, 120M and 120Y are driven to rotate in synchronization with the driving of the intermediate transfer belt 130.

Arranged around the photoreceptor drums 120 (K, C, M, and Y) are charging units (corona chargers) 211 (K, C, M, and Y) for uniformly charging the outer peripheral surface of each of the photoreceptor drums 120 (K, C, M, and Y), and organic EL array exposure heads 20 (K, C, M, and Y) having the above-mentioned structure of the invention for sequentially line-scanning the outer peripheral surfaces of the photoreceptor drums 120 (K, C, M, and Y), which has been uniformly charged by the charging units 211 (K, C, M, and Y), in synchronization with the rotation of the photoreceptor drums 120 (K, C, M, and Y).

Also arranged around the photoreceptor drums 120 (K, C, M, and Y) are developing devices 214 (K, C, M, and Y) for applying toner serving as a developer to an electrostatic latent image formed by the organic EL array exposure heads 20 (K, C, M, and Y) so as to form a visible image (toner image).

Here, the organic EL array exposure heads 20 (K, C, M, and Y) are disposed such that an array direction of the organic EL array exposure heads 20 (K, C, M, and Y) is in accordance with bus lines of the photoreceptor drums 120 (K, C, M, and Y). In addition, a light-emitting energy peak wavelength of each of the organic EL array exposure heads 20 (K, C, M, and Y) and the sensitivity peak wavelength of each of the photoreceptor drums 120 (K, C, M, and Y) are set to be approximately coincident with each other.

The developing devices 214 (K, C, M, and Y) use a non-magnetic single-component toner as a developer. The single-component developer is conveyed to a development roller through a supply roller, and the thickness of the developer layer adhered on the surface of the development roller is regulated by a regulating blade. The development roller is brought into contact with or pressed against the photoreceptor drums 120 (K, C, M, and Y) to allow the developer to adhered on the surface of the photoreceptor drums 120 (K, C, M, and Y) according to the electric potential level thereof, thereby developing the electrostatic latent image into a toner image.

Toner images of black, cyan, magenta and yellow formed by unicolor toner image forming stations for the four colors are sequentially primarily transferred onto the intermediate transfer belt 130 and are sequentially superimposed on the intermediate transfer belt 130 to form a full-color toner image. A recording medium 202 fed from a paper feeding cassette 201 one by one through a pickup roller 203 is then secondarily transferred to a secondary transfer roller 136. The toner image on the intermediate transfer belt 130 is secondarily transferred to a recording medium 202 such as a paper at the secondary transfer roller 136. The transferred full-color toner image is fixed on a recording medium 202 by passing between a pair of fixing rollers 137 serving as a fixing device. Then, the recording medium 202 is discharged through a pair of paper discharge rollers 138 onto a paper discharge tray formed on the top of the apparatus body.

As such, since the image forming apparatus of FIG. 15 uses the organic EL array serving as a writing unit, it is possible to further reduce a size of the image forming apparatus as compared with a case using a laser scanning optical system.

Next, an image forming apparatus according another embodiment of the invention will be described.

Figure 16:
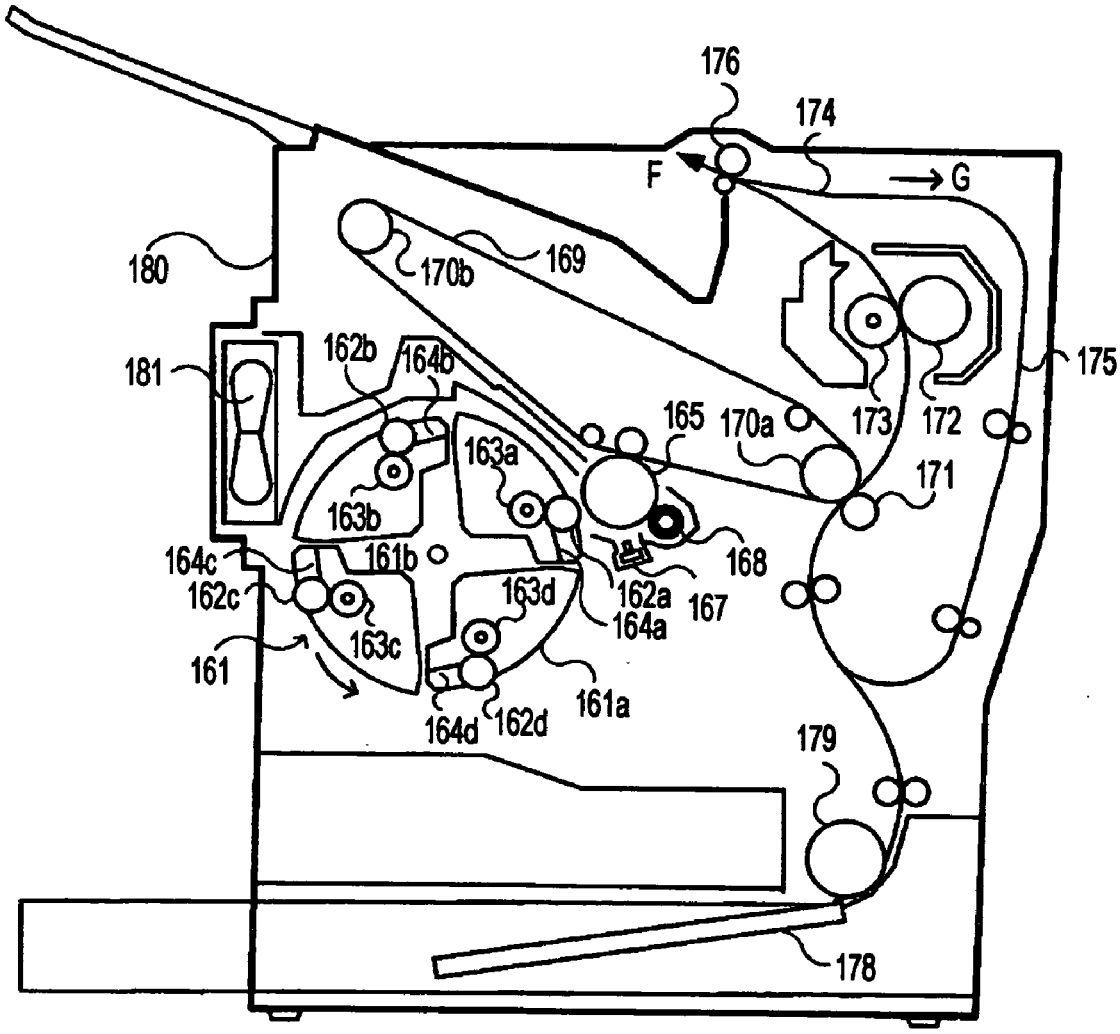
FIG. 16 is a longitudinal cross-sectional view showing a structure of an image forming apparatus according to a further aspect.

FIG. 16 is a longitudinal cross-sectional view of the image forming apparatus. In FIG. 16, the image forming apparatus includes, as essential elements, a rotary development device 161, a photoreceptor drum 165 serving as an image carrier, an exposure head 167 provided with an organic EL array, an intermediate transfer belt 169, a paper carrying path 174, a heating roller 172 of a fixer, and a paper feeding tray 178. The exposure head 167 is formed of the pixel unit 10 of the electro-optical device D according to the above-mentioned embodiment.

In the development device 161, a development rotary 161*a* rotates about a shaft 161*b* in a counterclockwise direction. The inside of a development rotary 161*a* is divided into four portions, and the corresponding four portions are provided with respective image forming units for four colors including yellow (Y), cyan (C), magenta (M), and black (K). The development rollers 162*a* to 162*d* and the toner supply rollers 163*a* to 163*d* are respectively disposed in the image forming units for the four colors. By means of the regulation blades 164*a* to 164*d*, the toner is regulated so as to have a predetermined thickness.

The photoreceptor drum 165 is charged by a charger 168 and is driven in a direction opposite to the development roller 162*a* by a driving motor (not shown), for example, a stepping motor. The intermediate transfer belt 169 is stretched between the driven roller 170*b* and the driving roller 170*a*, and the driving roller 170*a* is connected to a driving motor of the photoreceptor drum 165 to transmit a dynamic force to the intermediate transfer belt. The driving motor is driven, so that the driving roller 170*a* of the intermediate transfer belt 169 rotates in a direction opposite to the photoreceptor drum 165.

The paper carrying path 174 is provided with a plurality of carrying roller, a pair of paper discharge rollers 176 or the like so as to carry the paper. A single-sided image (toner image) carried on the intermediate transfer belt 169 is transferred to a single side of the paper at the location of a secondary transfer roller 171. The secondary transfer roller 171 is attached to or detached from the intermediate transfer belt 169 by means of a clutch. When the clutch is driven, the secondary transfer roller 171 is attached to the intermediate transfer belt 169, so that the image is transferred to the paper.

As such, the paper to which the image is transferred is then subjected to a fixing process by a fixer with a fixing heater. The fixer is provided with a heating roller 172 and a pressure roller 173. After the fixing process, the paper is drawn to the pair of paper discharge rollers 176 and moves in a direction shown by an arrow F. In this state, if the pair of paper discharge rollers 176 rotates in a revere direction, the direction of the paper is reversed, and the paper moves on the carrying path 175 for both-side printing in a direction shown by an arrow G. The paper is picked out by a pickup roller 179 from the paper feeding tray 178 one by one.

In the paper carrying path, a low-speed brushless motor is used as the driving motor for driving the carrying roller. In addition, the intermediate transfer belt 169 uses a stepping motor because the color deviation correction needs to be performed. These motors are controlled according to control signals from a control unit, which are not shown.

In this state, a yellow (Y) electrostatic latent image is formed in the photoreceptor drum 165 and the high voltage is applied to the development roller 162*a*, so that a yellow image is formed in the photoreceptor drum 165. If all of the rear side and the surface side of the yellow image are carried on the intermediate transfer belt 169, the development rotary 161*a* rotates at 90 degrees.

The intermediate transfer belt 169 rotates once to return to the location of the photoreceptor drum 165. Next, a double-sided cyan (C) image is formed in the photoreceptor drum 165. This cyan image is carried such that it is superimposed on the yellow image carried on the intermediate transfer belt 169. Hereinafter, in the same manner, repeatedly, after the development rotary 161 rotates at 90 degrees and the image is carried on the intermediate transfer belt 169, the development rotary 161 rotates once.

At the time of carrying the four-color images, the intermediate transfer belt 169 rotates four times, and then the rotation position is controlled, so that the image is transferred to the paper at the location of the secondary transfer roller 171. The paper fed from the paper feeding tray 178 is carried to the carrying path 174, and the color image is transferred to a single surface of the paper at the location of the secondary transfer roller 171. The paper in which the image is transferred to the single surface is reversed by the pair of paper discharge rollers 176, and enters a standby state in the carrying path. After that, the paper is conveyed to the location of the secondary transfer roller 171 with a proper timing, so that the color image is transferred to the other surface of the paper. A housing 180 is provided with an exhaust fan 181.

In addition, the above-mentioned electro-optical device D may be applied to an image reading apparatus. The image reading apparatus includes a light-emitting unit that irradiates light rays onto a subject, and a reading unit that reads out the light rays reflected on the subject to output the image signal. The above-mentioned electro-optical device D is used in the light-emitting unit. Here, a structure may be used in which the light-emitting unit moves and the reading unit is fixed and a structure may be used in which the light-emitting unit and the reading unit integrally move. In a case of the structure in which the light-emitting unit and the reading unit integrally move, the reading unit is formed of a TFT, so that the reading unit and the light-emitting unit may be formed on a single substrate. Examples of the image reading apparatus may include a scanner, a bar code reader, or the like.

Further, the electronic apparatus to which the electro-optical device according to the invention is applied is not limited to the image forming apparatus and the image reading apparatus. For example, in various electronic apparatuses, the electro-optical device according to the above-mentioned embodiments may be used as a display device. Further, examples of the electronic apparatus may include a personal computer, a cellular phone, a personal digital assistant (PDA), a digital still camera, a television, a video camera, a car navigation device, a pager, an electronic note, an electronic paper, a calculator, a word processor, a workstation, a video phone, a POS terminal, a printer, a scanner, a copy machine, a video player, an apparatus having a touch panel or the like.

Figure 17:
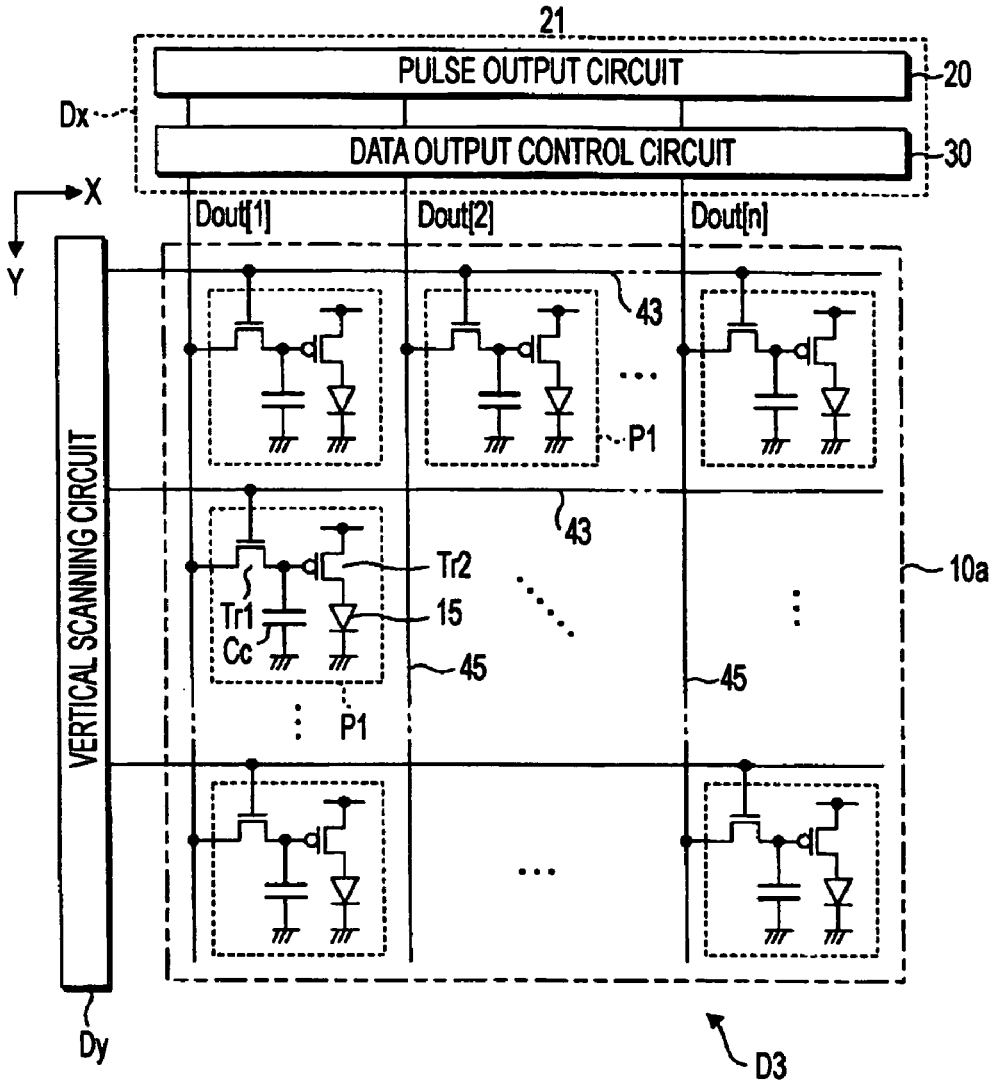
FIG. 17 is a block diagram showing a structure of an electro-optical device according to a further aspect.
Figure 18:
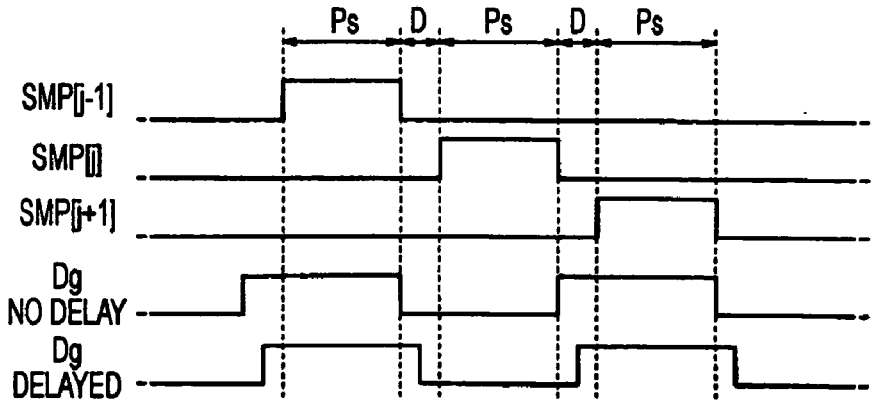
FIG. 18 is a timing chart illustrating a problem of a structure according to a related art.

Meanwhile, in the above-mentioned embodiments, the pixel unit 10 has been described in which the plurality of pixel circuits P are disposed in a line shape, but an electro-optical device in which a plurality of pixel circuits P are disposed in a surface shape is suitable for a display device of each of various electronic apparatuses. FIG. 17 is a block diagram showing a structure of the electro-optical device. As shown in FIG. 17, an electro-optical device D3 includes a vertical scanning circuit (scanning line driving circuit) Dy, a horizontal scanning circuit (data line driving circuit) Dx, and a display unit 10*a*. The horizontal scanning circuit Dx has the pulse output circuit 20 and the data output control circuit 30 shown in the above-mentioned embodiments. The display unit 10*a* is provided with a plurality of scanning lines 43 that extend in an X direction and are connected to the vertical scanning circuit Dy and n data lines 45 that extend in a Y direction and are connected to the data output control circuit 30 of the horizontal scanning circuit Dx (specifically, the output inverter 35 in the first embodiment and the clocked inverter 38 in the second embodiment).

A pixel circuit P1 is disposed at an intersection of each scanning line 43 and each data line 45. Each pixel circuit P1 has an n-channel-type transistor Tr1, a p-channel-type transistor Tr2, a capacitor Cc, and an OLED element 15 serving as an electro-optical element. The transistor Tr1 has a gate electrode connected to the scanning line 43 and a source electrode connected to the data line 45. The transistor Tr2 has a gate electrode connected to a drain electrode of the transistor Tr1 and a source electrode connected to a power supply line. The OLED element 15 has an anode connected to the drain electrode of the transistor Tr2 and a cathode connected to a ground. The capacitor Cc has one end connected to a drain electrode of the transistor Tr1.

The vertical scanning circuit Dy sequentially selects each of the plurality of scanning lines 43 and applies a voltage for turning on the transistor Tr1 to the selected scanning line 43. In this way, for a period for which the transistors Tr1 of pixel circuits P of one row are simultaneously turned on (horizontal scanning period), a voltage Dout applied to each of the data lines 45 by the horizontal scanning circuit Dx is held in the capacitor Cc. In addition, the transistor Tr2 is turned on or turned off in accordance with the voltage Dout, so that a current flowing into the OLED element 15 is controlled. In addition, the active-matrix-type electro-optical device D3 has been exemplified in which switching elements (transistors Tr1 and Tr2) for controlling the operation of the OLED element 15 are disposed in the pixel circuit P1, but the invention may be applied to a passive-matrix-type electro-optical device which does not have this kind of switching element.

Other Aspect

In the above-mentioned embodiments, the electro-optical devices D (D1, D2, and D3) using the OLED element 15 have been exemplified, but the invention may be applied to an electro-optical device using an electro-optical element other than the OLED element 15. For example, the invention may be applied to various electro-optical devices, such as a liquid crystal device using liquid crystal, an electro-optical device using an inorganic EL element, a field emission display (FED), a surface-conduction electron-emitter display (SED), a ballistic electron surface emitting display (BSD) or a display device using a light-emitting diode.

What is claimed is:

1. A driving circuit that drives an electro-optical device in which a gray-scale level of each of a plurality of electro-optical elements that correspond to a plurality of data lines is controlled on a basis of a voltage of a corresponding data line, the driving circuit comprising:

a pulse output circuit that outputs a plurality of sampling pulses, each of the plurality of sampling pulses becoming an active level sequentially;

a plurality of unit circuits each of which is supplied with a sampling pulse from the pulse output circuit;

a signal line that is supplied with a gray-scale signal to sequentially designate the gray-scale level of each of the electro-optical elements;

each of the plurality of unit circuits further including:

a logical sum circuit that outputs a signal output corresponding to a logical sum between a sampling pulse input to the corresponding unit circuit and a sampling pulse input to a unit circuit located at a front stage of the corresponding unit circuit;

a first switching element that samples the gray-scale signal supplied to the signal line in accordance with a sampling pulse output from the pulse output circuit;

a second switching element that is inserted between the first switching element and the data line and that enters an off state until a predetermined period passes from a time when the first switching element starts a sampling operation, the second switching element being controlled so as to be turned on or turned off based on the signal output from the logical sum circuit; and a storage capacitor that holds a voltage of an output terminal of the second switching element.

2. The driving circuit according to claim 1, the storage capacitor being a capacitor element, a first end of which is connected to the output terminal of the second switching element.

3. The driving circuit according to claim 2, further comprising:

first and second potential supply lines, each of which is supplied with an individual potential;

a smoothing capacitor that is arranged between the first potential supply line and the second potential supply line; and a second end of the storage capacitor being coupled with an end of the smoothing capacitor.

4. The driving circuit according to claim 3, further comprising:

an output buffer that is arranged between the second switching element and the data line; and the first and second potential supply lines being wiring lines that supply a power supply potential to the output buffer.

5. The driving circuit according to claim 1, the pulse output circuit including:

a shift register that sequentially generates a plurality of pulse signals, such that a period for which one pulse signal becomes an active level overlaps a period for which another pulse signal, that is subsequent to the one pulse signal, becomes an active level;

logical product circuits, each of which outputs a logical product between one pulse signal and another pulse signal, subsequent to the one pulse signal, as a sampling pulse; and the second switching element of each unit circuit being controlled to be turned on or turned off based on a pulse signal output from the shift register.

6. The driving circuit according to claim 1, each unit circuit having a delay element that is arranged between the signal line and the first switching element; and the second switching element of each unit circuit being controlled so as to be turned on or turned off based on a sampling pulse output from the pulse output circuit.

7. The driving circuit according to claim 1, the second switching element being a transmission gate.

8. The driving circuit according to claim 1, the second switching element being a clocked inverter having an output terminal that enters a high impedance state in an off state and that serves as an inverter in an on state.

9. An electro-optical device, comprising:

a plurality of electro-optical elements that correspond to a plurality of data lines, each having a gray-scale level based on a voltage of a corresponding data line;

a pulse output circuit that outputs a plurality of sampling pulses, each of the plurality of sampling pulses becoming an active level sequentially;

a plurality of unit circuits each of which is supplied with a sampling pulse output from the pulse output circuit;

a signal line that is supplied with a gray-scale signal to sequentially designate a gray-scale level of each of the electro-optical elements;

each of the plurality of unit circuits further including:

a logical sum circuit that outputs a signal output corresponding to a logical sum between a sampling pulse input to the corresponding unit circuit and a sampling pulse input to a unit circuit located at a front stage of the corresponding unit circuit;

a first switching element that samples the gray-scale signal supplied to the signal line in accordance with a sampling pulse output from the pulse output circuit;

a second switching element that is inserted between the first switching element and the data line and that enters an off state until a predetermined period passes from a time when the first switching element starts a sampling operation, the second switching element being controlled so as to be turned on or turned off based on the signal output from the logical sum circuit; and a storage capacitor that holds a voltage of an output terminal of the second switching element.

10. The electro-optical device according to claim 9, the electro-optical element being arranged between a first power supply line having a first potential and a second power supply line having a second potential that is different from the first potential; and the storage capacitor further including:

a first capacitor element that has a first end coupled with an output terminal of the second switching element and has a second end coupled with the first power supply line; and a second capacitor element that has a first end coupled with an output terminal of the second switching element and has a second end coupled with the second power supply line.

11. The electro-optical device according to claim 9, further comprising:

a plurality of pixel circuits, each including the electro-optical element;

each of the plurality of pixel circuits having a transistor that controls a voltage applied to the electro-optical element based on a voltage applied to a gate electrode through a corresponding data line; and the storage capacitor being a gate capacitor of the transistor.

12. A mobile communication device, comprising:

the electro-optical device according to claim 9.

* * * * *

UNITED STATES PATENT AND TRADEMARK OFFICE

CERTIFICATE OF CORRECTION

PATENT NO. : 7,633,480 B2
APPLICATION NO. : 11/322219
DATED : December 15, 2009
INVENTOR(S) : Kubota et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1018 days.

Signed and Sealed this

Ninth Day of November, 2010

David J. Kappos

David J. Kappos
*Director of the United States Patent and Trademark Office*